US009079442B2

(12) United States Patent
Arakane

(10) Patent No.: US 9,079,442 B2
(45) **Date of Patent: *Jul. 14, 2015**

(54) INKJET PRINTER

(71) Applicant: BROTHER KOGYO KABUSHIKI KAISHA, Nagoya, Aichi (JP)

(72) Inventor: Satoru Arakane, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/341,015

(22) Filed: Jul. 25, 2014

(65) Prior Publication Data

US 2015/0029263 A1 Jan. 29, 2015

(30) Foreign Application Priority Data

Jul. 29, 2013 (JP) ..... 2013-156403

(51) Int. Cl.
*B41J 29/38* (2006.01)
*B41J 29/393* (2006.01)
*B41J 2/045* (2006.01)

(52) U.S. Cl.
CPC ..... *B41J 29/393* (2013.01); *B41J 2/04503* (2013.01); *B41J 2/04556* (2013.01)

(58) Field of Classification Search
CPC ..... B41J 29/393; B41J 11/007; B41J 11/008; B41J 11/42; B41J 25/308; B41J 19/76; B41J 2/04503; B41J 2/04556
USPC ..... 347/8, 9, 14, 16, 37, 101, 104
See application file for complete search history.

(56) References Cited

U.S. PATENT DOCUMENTS 5,874,979 A 2/1999 Ohyama
6,471,315 B1 10/2002 Kurata
(Continued)

FOREIGN PATENT DOCUMENTS

JP HEI 05-155009 A 6/1993
JP HEI 9-48161 A 2/1997
(Continued)

OTHER PUBLICATIONS

Notice of Allowance dated Feb. 11, 2015 issued in U.S. Appl. No. 14/107,035.
(Continued)

*Primary Examiner* — An Do
(74) *Attorney, Agent, or Firm* — Scully, Scott, Murphy & Presser, P.C.

(57) ABSTRACT

An inkjet printer having a conveyer, a recording head, a carriage, a corrugation mechanism, and a controller is provided. The controller executes an operation including a conveying step to convey a sheet and a recording step to discharge ink toward the sheet. The recording step includes a first discharging step, in which the recording head is manipulated to discharge the ink toward a targeted position on the sheet along a scanning direction at a first discharging timing, and a second discharging step, in which the recording head is manipulated to discharge the ink toward the targeted position on the sheet at a second discharging timing which is deviated from the first discharging timing. The farther the targeted position is separated from a reference position on the sheet along the main scanning direction, the more largely the second discharging timing is deviated from the first discharging timing.

21 Claims, 13 Drawing Sheets

(56) References Cited

U.S. PATENT DOCUMENTS

| | | | | |
|---|---|---|---|---|
| 7,237,858 | B2 * | 7/2007 | Igarashi | 347/8 |
| 8,567,905 | B2 * | 10/2013 | Ogasawara | 347/37 |
| 2004/0126164 | A1 | 7/2004 | Ohyama | |
| 2005/0088471 | A1 | 4/2005 | Endo | |
| 2007/0291056 | A1 | 12/2007 | Tanahashi et al. | |
| 2009/0219322 | A1 | 9/2009 | Terada | |
| 2010/0039473 | A1 | 2/2010 | Terada | |
| 2010/0244357 | A1 | 9/2010 | Takahata | |
| 2011/0063352 | A1 | 3/2011 | Sakurada et al. | |
| 2011/0157269 | A1 | 6/2011 | Teramae | |
| 2011/0175958 | A1 | 7/2011 | Sato et al. | |
| 2011/0298854 | A1 | 12/2011 | Sakurada et al. | |
| 2014/0168300 | A1 | 6/2014 | Kubo et al. | |
| 2014/0204141 | A1 * | 7/2014 | Arakane | 347/14 |

FOREIGN PATENT DOCUMENTS

| | | | |
|---|---|---|---|
| JP | HEI 11-240146 | A | 9/1999 |
| JP | 2004-017586 | A | 1/2004 |
| JP | 2004-106978 | A | 4/2004 |
| JP | 2005-246642 | A | 9/2005 |
| JP | 2006-102997 | A | 4/2006 |
| JP | 2006-192636 | A | 7/2006 |
| JP | 2007-144718 | A | 6/2007 |
| JP | 2007-331297 | A | 12/2007 |
| JP | 2007-331315 | A | 12/2007 |
| JP | 2008-221729 | A | 9/2008 |
| JP | 2009-128822 | A | 6/2009 |
| JP | 2009-143152 | A | 7/2009 |
| JP | 2009-196367 | A | 9/2009 |
| JP | 2009-202430 | A | 9/2009 |
| JP | 2009-208273 | A | 9/2009 |
| JP | 2010-042646 | A | 2/2010 |
| JP | 2011-079296 | A | 4/2011 |
| JP | 2014-136419 | A | 7/2014 |
| JP | 2014-139002 | A | 7/2014 |

OTHER PUBLICATIONS

U.S. Office Action dated Sep. 4, 2014 received in related U.S. Appl. No. 14/107,035.

U.S. Office Action dated Nov. 20, 2014 received in related U.S. Appl. No. 14/341,080.

U.S. Office Action dated Dec. 24, 2014 received in related U.S. Appl. No. 14/158,000.

U.S. Appl. No. 14/341,080, filed Jul. 25, 2014.

U.S. Office Action dated Mar. 20, 2015 issued in U.S. Appl. No. 14/158,000.

Notice of Allowance dated Mar. 5, 2015 issued in U.S. Appl. No. 14/341,080.

* cited by examiner

| REFERENCE VALUE | D0 | | | | | | | | |
|---|---|---|---|---|---|---|---|---|---|
| PEAK DEVIATION VALUE | $Y_{(2)}$ | $Y_{(4)}$ | $Y_{(6)}$ | $Y_{(8)}$ | $Y_{(10)}$ | $Y_{(12)}$ | $Y_{(14)}$ | $Y_{(16)}$ | |
| BOTTOM DEVIATION VALUE | $Y_{(1)}$ | $Y_{(3)}$ | $Y_{(5)}$ | $Y_{(7)}$ | $Y_{(9)}$ | $Y_{(11)}$ | $Y_{(13)}$ | $Y_{(15)}$ | $Y_{(17)}$ |
| ADJUSTING VALUE $\alpha$ | $\alpha_{(1)}$ | $\alpha_{(2)}$ | $\alpha_{(3)}$ | $\alpha_{(4)}$ | $\alpha_{(5)}$ | $\alpha_{(6)}$ | ··· | $\alpha_{(16)}$ | $\alpha_{(17)}$ |
| ADJUSTING VALUE $\beta$ | $\beta_{(1)}$ | $\beta_{(2)}$ | $\beta_{(3)}$ | $\beta_{(4)}$ | $\beta_{(5)}$ | $\beta_{(6)}$ | ··· | $\beta_{(16)}$ | $\beta_{(17)}$ |

FIG. 12

INKJET PRINTER

CROSS-REFERENCE TO RELATED APPLICATION

This application claims priority under 35 U.S.C. §119 from Japanese Patent Application No. 2013-156403 filed on Jul. 29, 2013. The entire subject matter of the application is incorporated herein by reference.

BACKGROUND

1. Technical Field

The following description relates to an inkjet printer.

2. Related Art

An inkjet printer configured to record an image by discharging ink onto a sheet is known. The inkjet printer may be configured to form the sheet into a corrugated shape waving up and down along a scanning direction, which intersects with a direction to convey the sheet. Such an inkjet printer may be equipped with a platen and a sheet-pressing plate. The platen may be formed to have convex portions and concave portions on an upper surface thereof. The sheet-pressing plate may be arranged in a position to face the platen. While the sheet is placed in a position between the platen and the sheet-pressing plate, the sheet may be deformed into the corrugated shape.

SUMMARY

In the inkjet printer mentioned above, an amount of amplitude of the sheet in a vertical direction and a dimension of the sheet in the scanning direction being placed in between the platen and the sheet-pressing plate may be different from those of a sheet not being in the position between the platen and the sheet-pressing plate. In other words, a shape of the sheet may vary depending on the positions in the inkjet printer; therefore, it may be required to adjust timings to discharge the ink onto the sheet depending on the positions.

Aspects of the present invention are advantageous in that an inkjet printer, in which ink is discharged onto a corrugated-shaped sheet in preferable timings adjusted in accordance with the shape of the sheet, is provided.

According to an aspect of the present invention, an inkjet printer is provided. The inkjet printer includes a conveyer configured to convey a sheet along a conveyance direction; a recording head configured to discharge ink toward the sheet being conveyed by the conveyer; a carriage mounting the recording head thereon and being configured to move along a scanning direction; a corrugation mechanism configured to shape into a corrugated shape, in which an amount of a gap between the recording head and the sheet is increased and decreased alternately along the scanning direction, at a corrugating position; and a controller. The controller is configured to execute an operation including a conveying step, in which the sheet is conveyed by the conveyer; and a recording step, in which the carriage is moved in the scanning direction and the recording head is manipulated to discharge the ink toward the sheet. The recording step includes a first discharging step, in which, after the conveying step and on condition that the sheet is present at the corrugating position, the recording head is manipulated to discharge the ink toward a targeted position on the sheet along the scanning direction at a first discharging timing; and a second discharging step, in which, after the conveying step and on condition that the sheet is absent at the corrugating position, the recording head is manipulated to discharge the ink toward the targeted position on the sheet along the scanning direction at a second discharging timing which is deviated from the first discharging timing, the farther the targeted position being separated from a reference position on the sheet along the scanning direction, the more largely the second discharging timing being deviated from the first discharging timing.

According to another aspect of the present invention, a method to record an image on a sheet in an inkjet printer is provided. The method includes steps of conveying the sheet by a conveyer; and recording by moving a carriage in a scanning direction, and manipulating a recording head mounted on the carriage to discharge ink toward the sheet shaped into a corrugated shape along the scanning direction at a corrugating position. The step of recording includes a first discharging step, in which, after the conveying step and on condition that the sheet is present at the corrugating position, the recording head is manipulated to discharge the ink toward a targeted position on the sheet along the scanning direction at a first discharging timing; and a second discharging step, in which, after the conveying step and on condition that the sheet is absent at the corrugating position, the recording head is manipulated to discharge the ink toward the targeted position on the sheet along the scanning direction at a second discharging timing which is deviated from the first discharging timing, the farther the targeted position being separated from a reference position on the sheet along the scanning direction, the more largely the second discharging timing being deviated from the first discharging timing.

BRIEF DESCRIPTION OF THE ACCOMPANYING DRAWINGS

Figure 6:
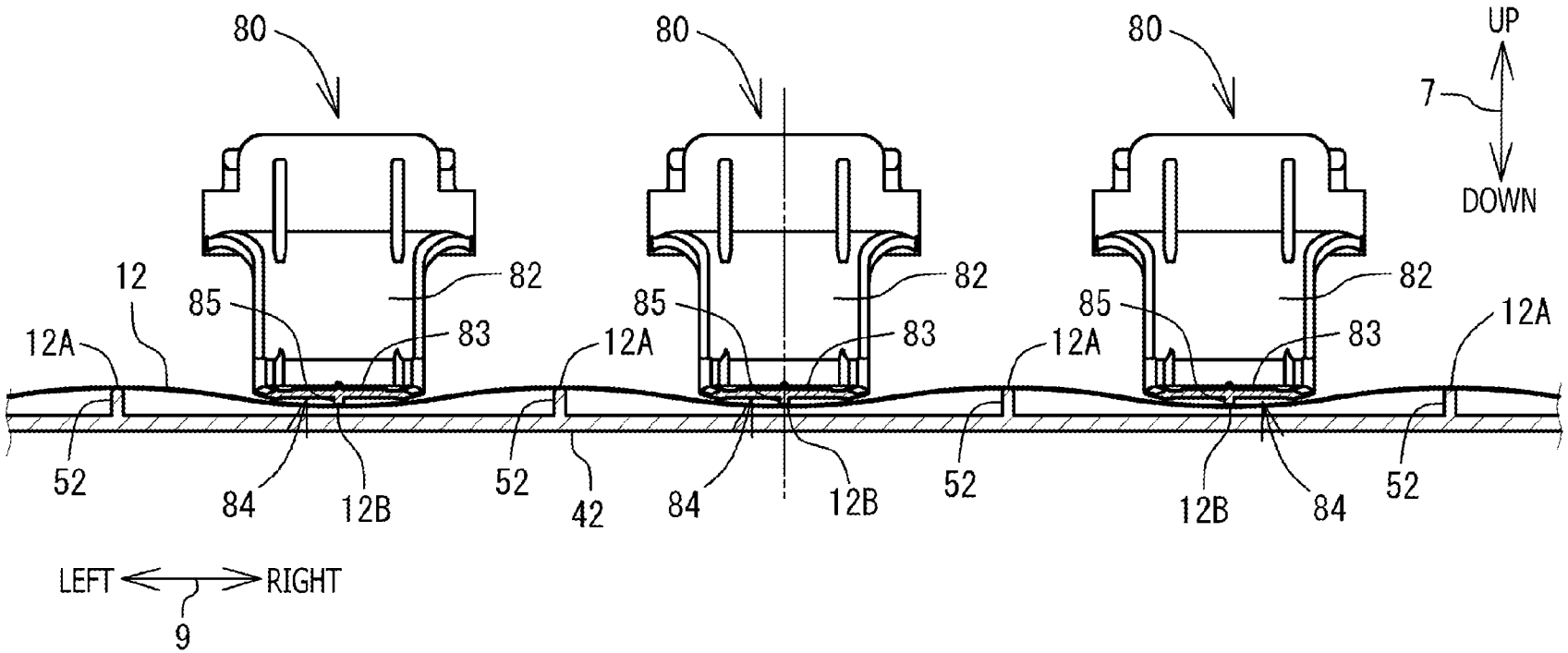

FIG. 6 is a cross-sectional view to illustrate relative positions between supporting ribs 52 in the platen 42 and contacting ribs 85 in the contact pieces 80 in the MFD 10.

Figure 7:
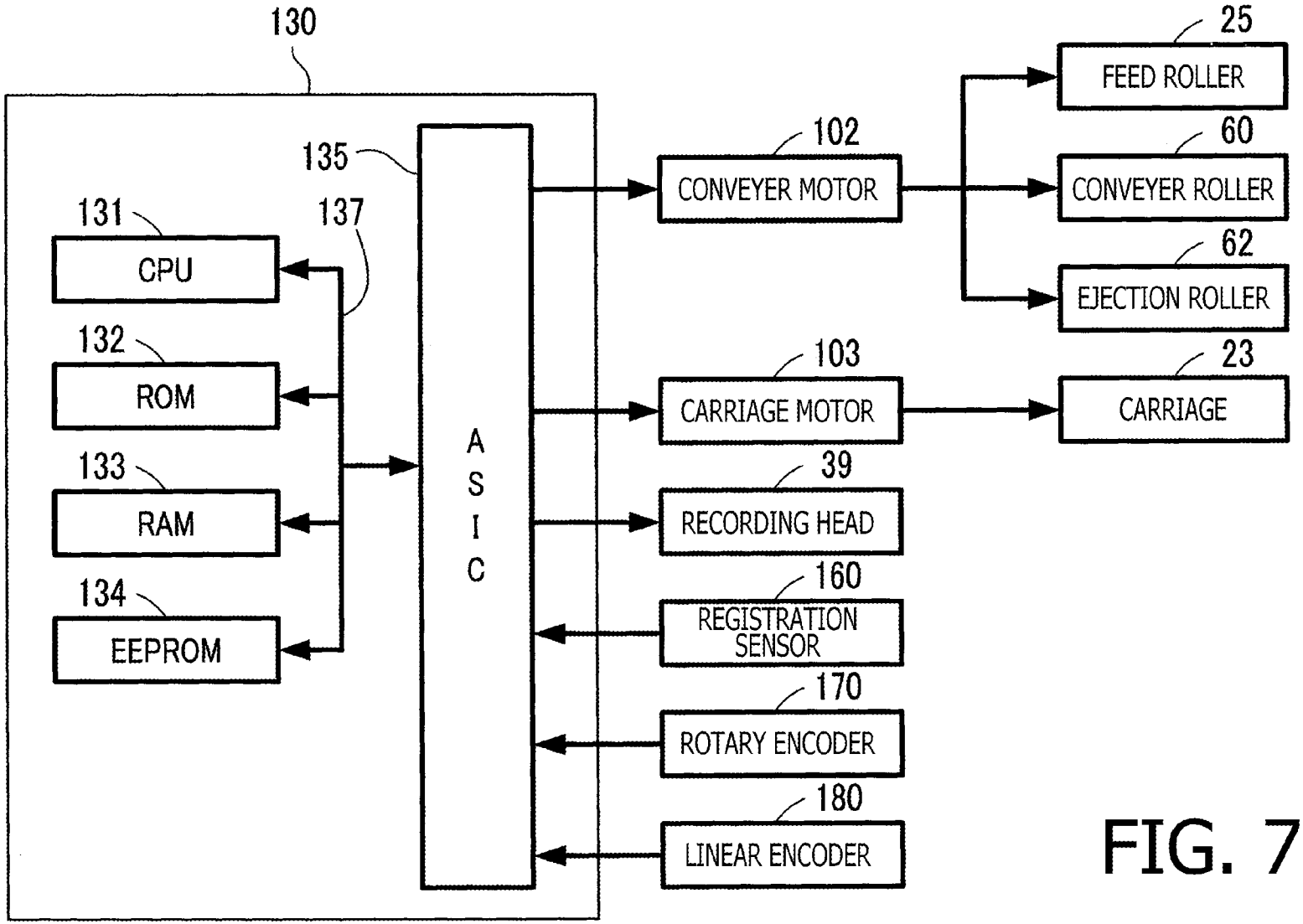

FIG. 7 is a block diagram to illustrate configurations of a controller 130 and other related parts in the MFD 10.

Figure 8:
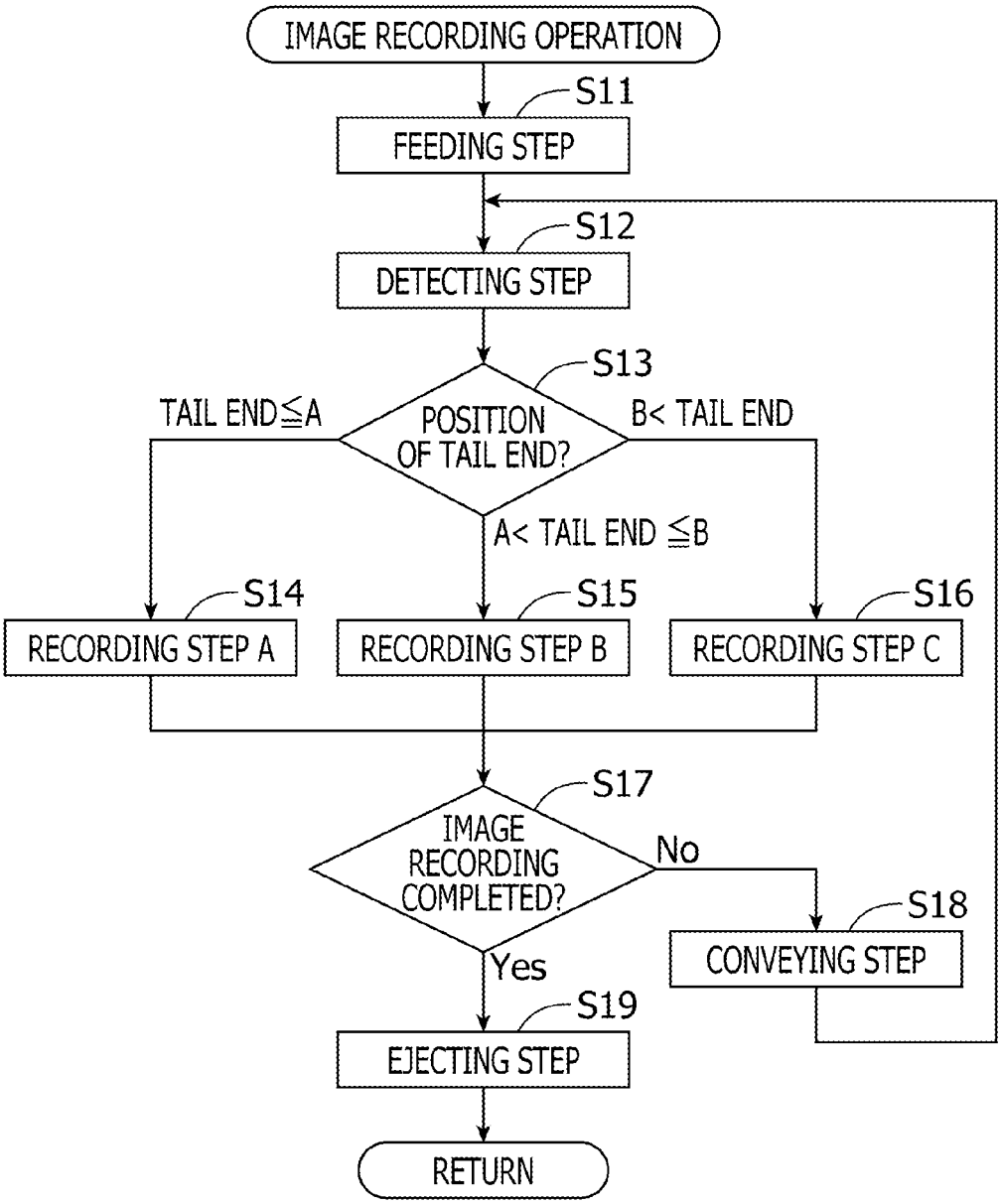

FIG. 8 is a flowchart to illustrate a flow of an image recording operation to be performed by the controller 130 in the MFD 10.

Figure 9:
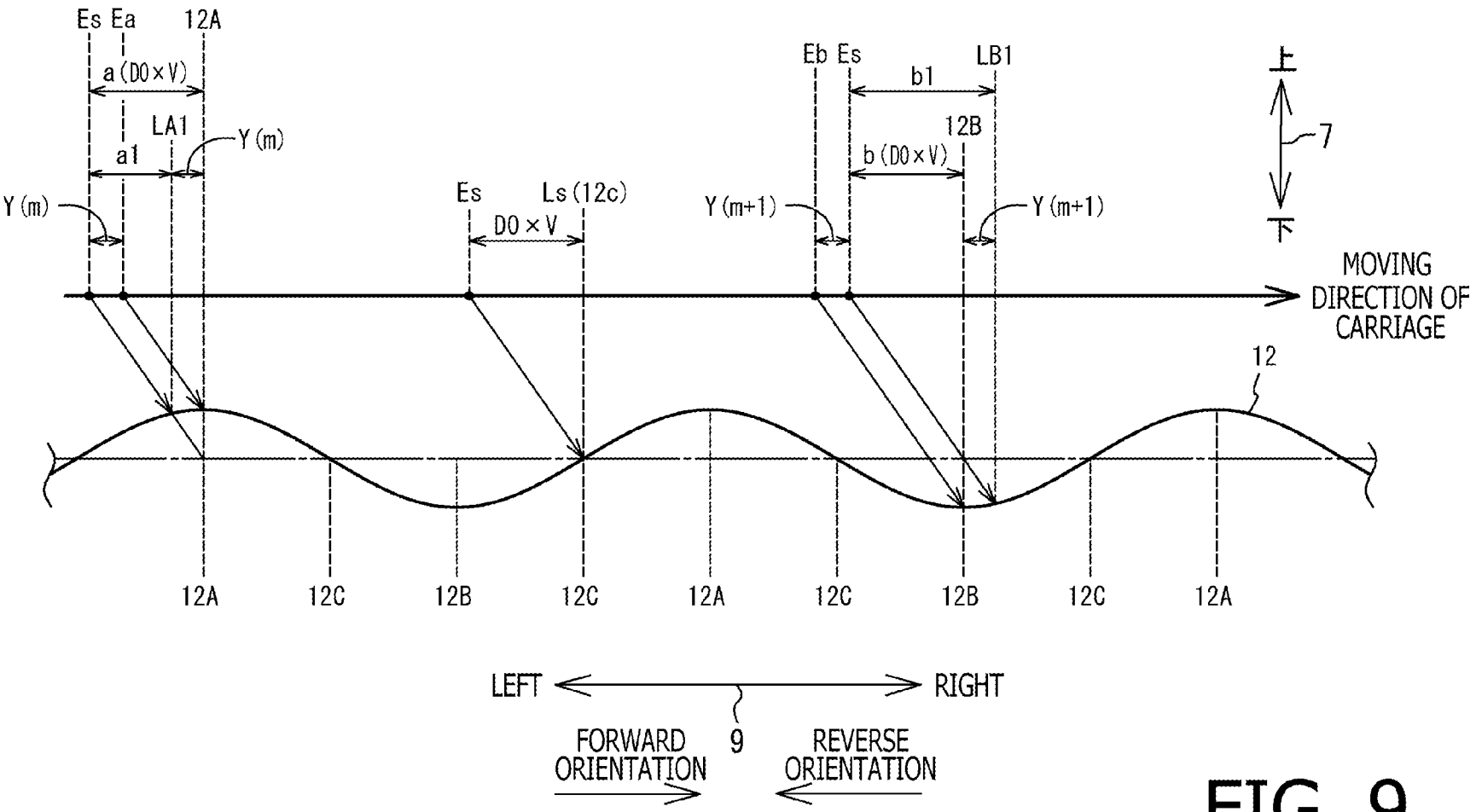

FIG. 9 is a diagram to illustrate a reference value D0, a peak deviation value Y (m), and a bottom deviation value Y (m+1) with respect to the sheet 12 in the MFD 10.

Figure 10:
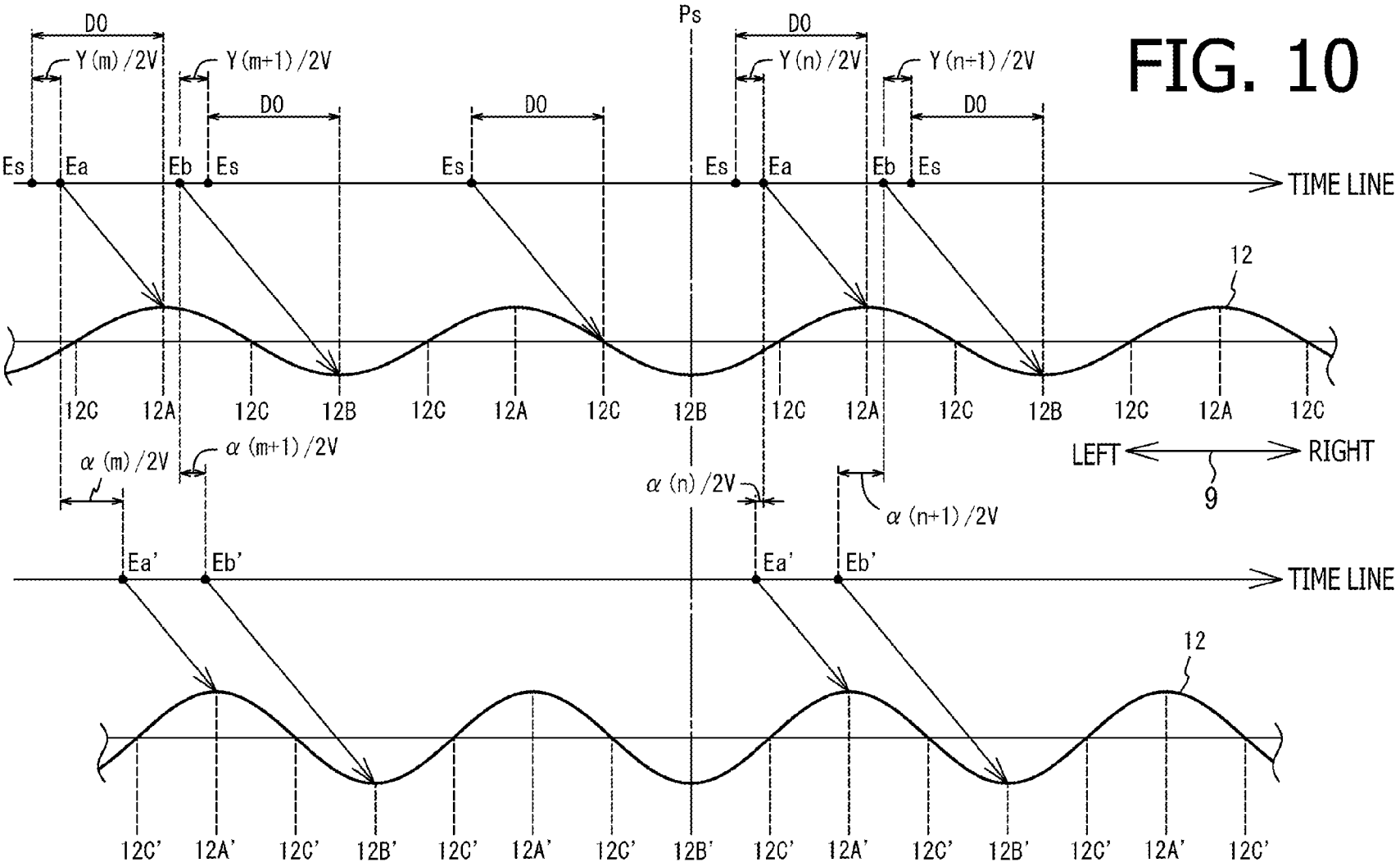

FIG. 10 illustrates a shape of the sheet 12 before a tail end of the sheet 12 passes through a position A and a shape of the sheet 12 after the tail end of the sheet 12 passes through the position A in the MFD 10.

Figure 11:
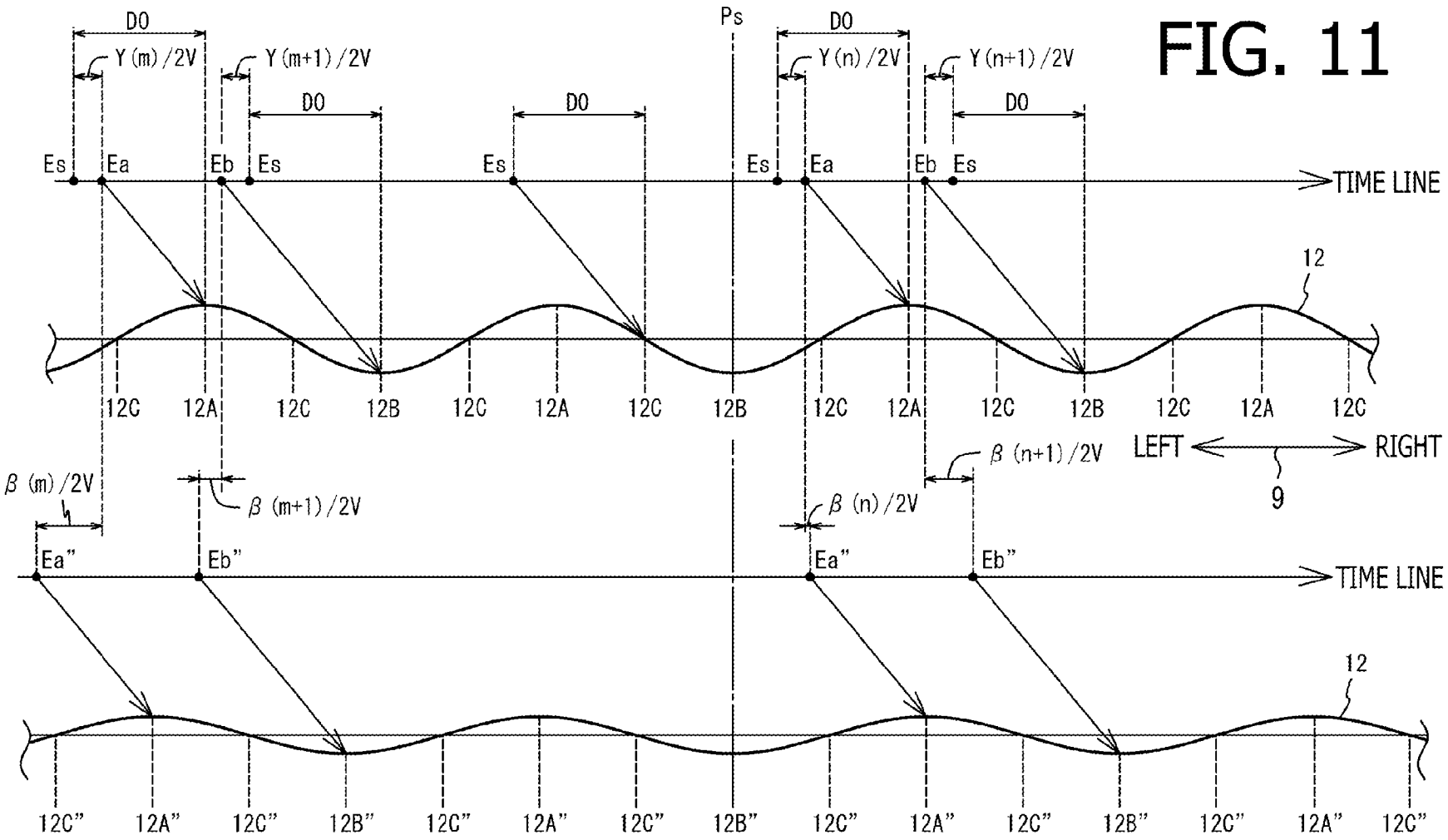

FIG. 11 illustrates a shape of the sheet 12 before the tail end of the sheet 12 passes through the position A and a shape of the sheet 12 after the tail end of the sheet 12 passes through the position B in the MFD 10.

FIG. 12 illustrates a data structure in an EEPROM 134 in the MFD 10.

Figure 13A:
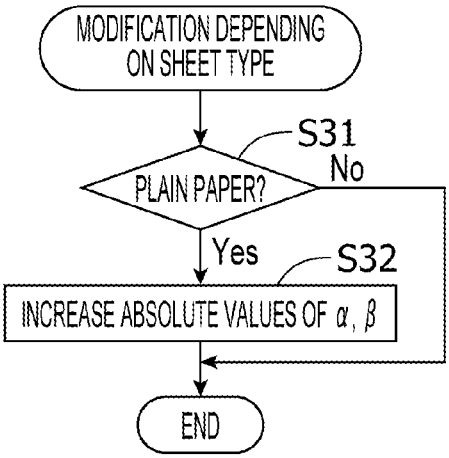
Figure 13B:
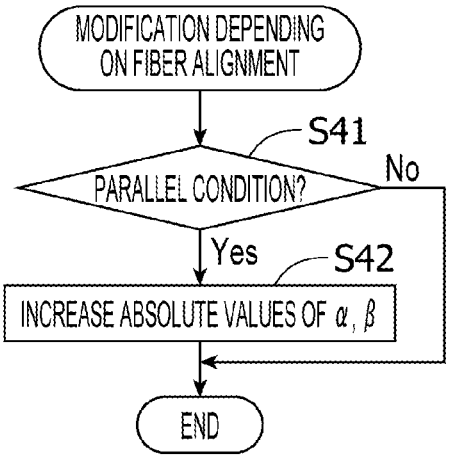
Figure 13C:
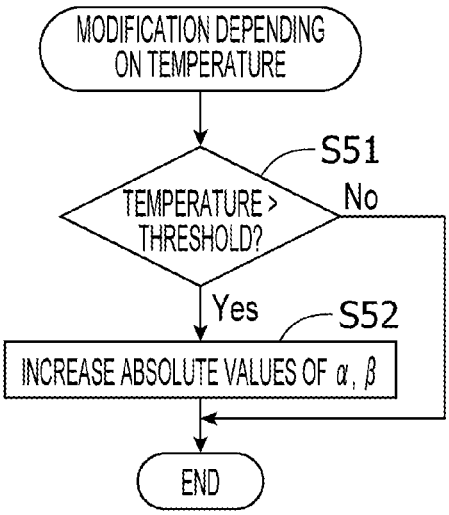
Figure 13D:
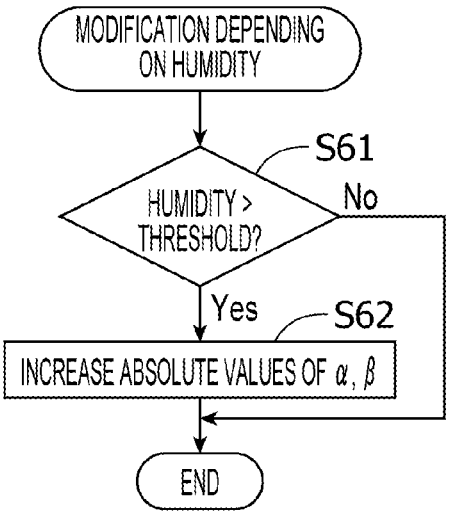

FIG. 13A is a flowchart to illustrate an operation to modify corrected discharging timings depending on a type of the sheet 12 in the MFD 10. FIG. 13B is a flowchart to illustrate an operation to modify corrected discharging timings depending on a fiber alignment in the sheet 12 in the MFD 10. FIG. 13C is a flowchart to illustrate an operation to modify corrected discharging timings depending on ambient temperature around the MFD 10. FIG. 13D is a flowchart to illustrate an operation to modify corrected discharging timings depending on ambient humidity around the MFD 10.

DETAILED DESCRIPTION

Hereinafter, an embodiment according to aspects of the present invention will be described in detail with reference to the accompanying drawings. It is noted that various connections are set forth between elements in the following description. These connections in general, and unless specified otherwise, may be direct or indirect and that this specification is not intended to be limiting in this respect. Aspects of the invention may be implemented in computer software as programs storable on computer readable media including but not limited to RAMs, ROMs, flash memories, EEPROMs, CD-media, DVD-media, temporary storage, hard disk drives, floppy drives, permanent storage, and the like.

In the following description, a vertical direction 7 is defined with reference to an up-to-down or down-to-up direction for the MFD 10 in an ordinarily usable posture (see FIG. 1). In other words, the up-to-down or down-to-up direction in FIG. 1 coincides with the vertical direction 7. Further, other directions concerning the MFD 10 will be referred to based on the ordinarily usable posture of the MFD 10: a viewer's lower-left side in FIG. 1, on which an opening 13 is formed, is defined to be a front side of the MFD 10, and a side opposite from the front side, i.e., a viewer's upper-right side, is defined as a rear side of the MFD 10. A front-to-rear or rear-to-front direction is defined as a direction of depth and may be referred to as a front-rear direction 8. An upper-left side in FIG. 1, which comes on the user's left-hand side with respect to the MFD 10 when the user faces the front side, is referred to as a left side or a left-hand side. A side opposite from the left, which is on the viewer's lower-right side, is referred to as a right side or a right-hand side. A right-to-left or left-to-right direction of the MFD 10 may also be referred to as a right-left direction 9 or a widthwise direction 9. The directions shown in FIGS. 2-6 and 9-11 correspond to those indicated by the arrows appearing in FIG. 1.

[Overall Configuration of the MFD 10]

Figure 1:
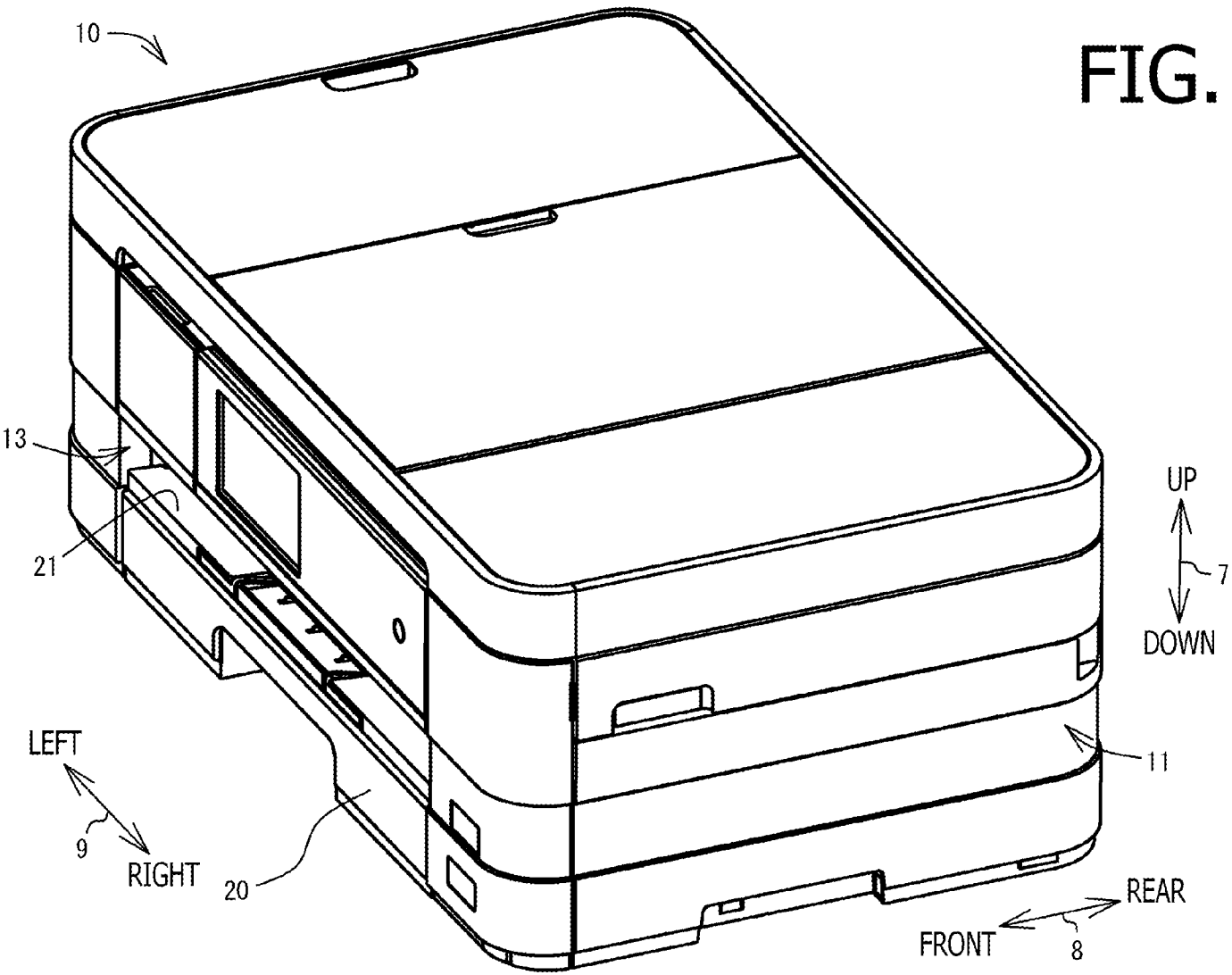
FIG. 1 is an external perspective view of a multifunction device (MFD) 10.

As depicted in FIG. 1, the MFD 10 has an overall shape of a six-sided rectangular box and contains a printer part 11, in which an image can be recorded on a sheet 12 (see FIG. 2) in an inkjet recording method, in a lower position thereof. In other words, the MFD 10 is equipped with a printing function. The MFD 10 is a multi-functional device having a plurality of functions, including, for example, a facsimile transmission receiving function, additionally to the printing function. In the following description, however, description of configurations concerning the functions other than the printing function will be omitted.

Figure 2:
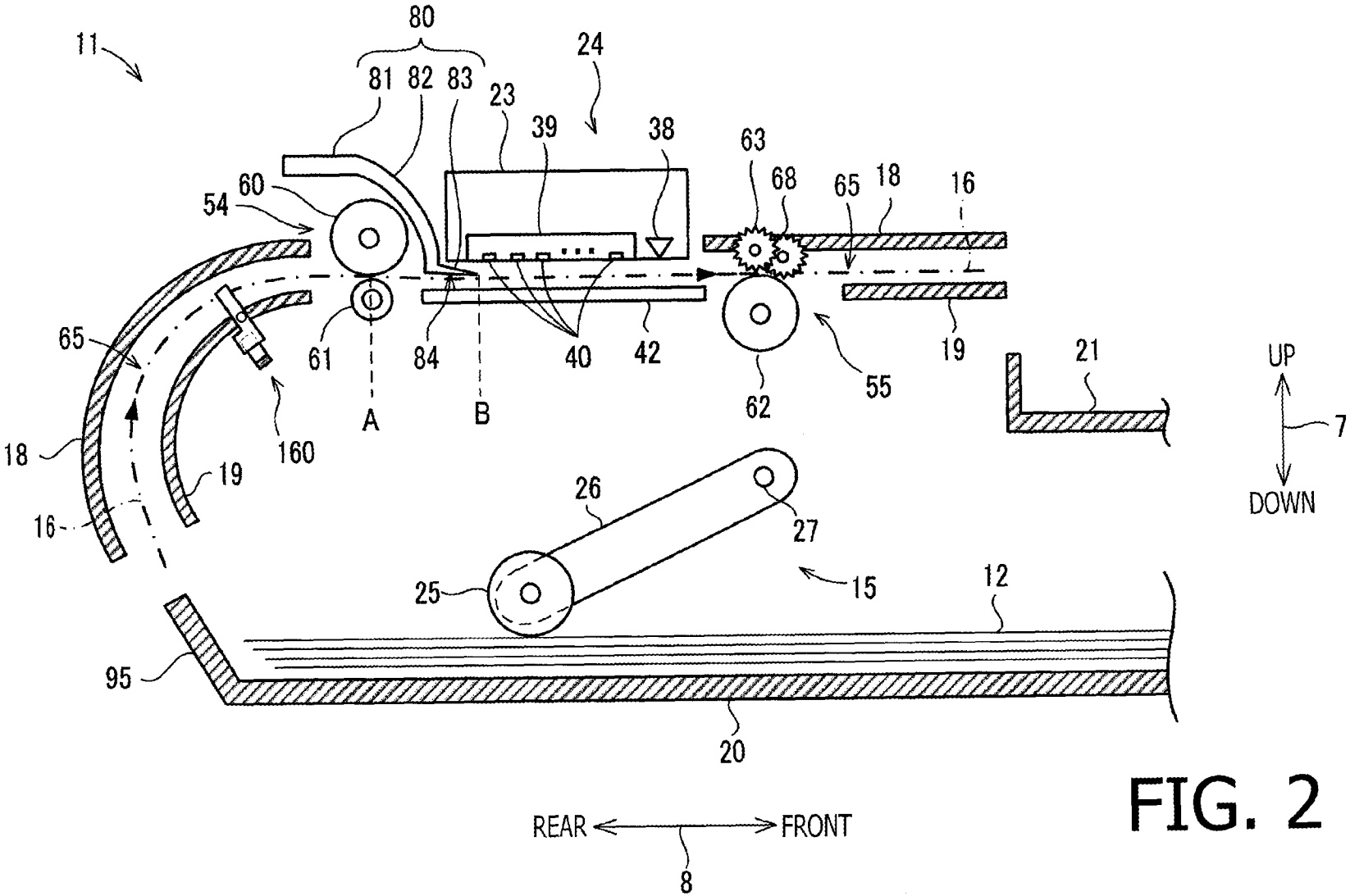
FIG. 2 is a cross-sectional view of an internal structure of a printer unit 11 in the MFD 10.

As depicted in FIG. 2, the printer part 11 includes a feeder unit 15, a feeder tray 20, an ejection tray 21, a conveyer roller unit 54, a recording unit 24, an ejection roller unit 55, a platen 42, corrugating spurs 68, and contact pieces 80. The feeder unit 15 is configured to pick up the sheet 12 from the feeder tray 20 and feed the picked-up sheet 12 in a conveyer path 65. The conveyer roller unit 54 conveys the sheet 12 fed by the feeder unit 15 in the conveyer path 65 further toward a downstream along a direction of conveyance flow 16. The recording unit 24 records an image on the sheet 12 conveyed by the conveyer roller unit 54. The ejection roller unit 55 ejects the sheet 12 with the image recorded thereon by the recording unit 24 in the ejection tray 21. The platen 42 supports the sheet 12 being conveyed by the conveyer roller unit 54 from below. The corrugating spurs 68 and the contact pieces 80 press the sheet 12 being conveyed by the conveyer roller unit 54 downward toward the platen 42.

[Feeder Tray 20]

Figure 3:
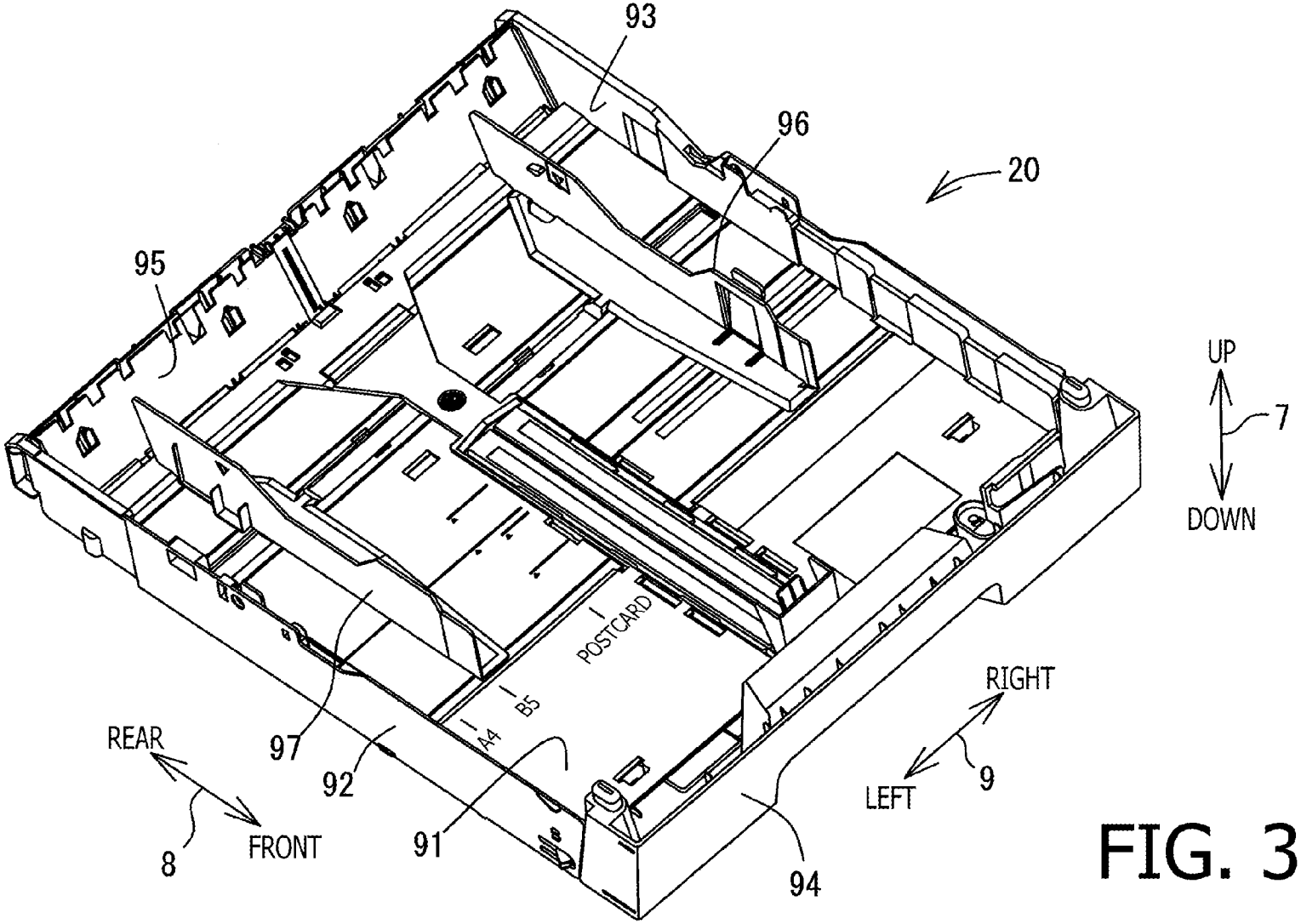
FIG. 3 is a perspective view of a feeder tray 20 in the MFD 10.

The feeder tray 20 is inserted through the opening 13 along the front-rear direction 8 to be installed in the printer part 11 formed on the front side of the printer part 11. The feeder tray 20 can support one or more sheets 12 to store therein. The ejection tray 21 is provided in an upper position with respect to the feeder tray 20. The feeder tray 20 is, as shown in FIG. 3, formed to have a shape of a top-open box, which includes a bottom panel 91, a left-side panel 92, a right-side panel 93, a front panel 94, and an oblique panel 95. The front panel 94 projects upward from a front end of the bottom panel 91. The ejection tray 21 is supported in the printer part 11 through the left-side panel 92, the right-side panel 93, and the front panel 94 (see FIG. 1). The oblique panel 95 spreads upper-rearward from a rear end of the bottom panel 91 and guides the sheet 12 conveyed from the feeder unit 15 toward the recording unit 24.

The bottom panel 91 is configured to support a plurality of predetermined sizes of sheet 12, which include, for example, sizes of A4, B5, legal, and postcard. On a surface of the bottom panel 91, widthwise end positions of the predetermined sizes on one side along the widthwise direction 9 (e.g., in FIG. 3, left-side ends of the predetermined sizes) are marked. For example, in FIG. 3, end positions of the A4, B5, and postcard sizes are indicated; however, the end marks are not necessarily limited to the above three sizes. On the bottom panel 91, further, guide pieces 96, 97, which guide widthwise positions of the sheet 12 supported by the bottom panel 91, are provided. The guide pieces 96, 97 centers the sheet 12 on the bottom panel 91 at a center position along the widthwise direction 9 and restrict the sheet 12 from skewing. With the guide pieces 96, 97, a widthwise center of the sheet 12 is placed in a center-aligned position coincident with a widthwise center of the bottom panel 91.

More specifically, when centering the sheet 12, firstly, a user sets the sheet 12 on the bottom panel 91. Secondly, the user slidably moves one of the guide pieces 96, 97, e.g., the guide piece 96, leftward along the widthwise direction 9 to a position marked as the widthwise end of a correct sheet size for the sheet 12. Thus, the guide piece 96 contacts a right-side end of the sheet 12. In this regard, the other one of the guide pieces 96, 97, e.g., the guide piece 97, is moved rightward in conjunction with the guide piece 96 via a pinion gear (not shown) until the guide piece 97 contacts a left-side end of the sheet 12. Thus, the sheet 12 in one of the predetermined sizes placed on the bottom panel 91 is centered by the guide pieces 96, 97 at the widthwise center position of the bottom panel 91.

[Feeder Unit 15]

As depicted in FIG. 2, the feeder unit 15 is arranged in an upper position with respect to the feeder tray 20 being attached to the printer part 11 through the opening 13. The feeder unit 15 includes a feed roller 25, a feeder arm 26, and a shaft 27. The feed roller 25 is rotatably attached to one end of the feeder arm 26, which is movable upward and downward to be closer to and farther from the feeder tray 20. The feed roller 25 is rotatable by a driving force, which is generated by a conveyer motor 102 (see FIG. 7). The feeder arm 26 is pivotably supported by the shaft 27, which is supported by a frame (not shown) of the printer part 11. The feeder arm 26 is urged downward by weight thereof and/or resilient force provided by, for example, a spring. When one or more sheets 12 are placed in the feeder tray 20, and when the feed roller 25 rotates, a topmost one of the sheets 12 placed in the feeder tray 20 is picked up and fed in the conveyer path 65.

[Conveyer Path 65]

As depicted in FIG. 2, the conveyer path 65 refers to an area partitioned by an outer guide member 18 and an inner guide member 19, which are arranged in the printer part 11 to face each other. The conveyer path 65 rises from a rear end of the feeder tray 20 and curves upper-frontward in the printer part 11 to extend from the rear side along the recording unit 24 to the ejection tray 21. More specifically, the conveyer path 65 extends through a nipped position in the conveyer roller unit 54, a position between the platen 42 and a recording head 39, and a nipped position in the ejection roller unit 55 to the ejection tray 21. The conveyance flow 16 of the sheet 12 to be conveyed in the conveyer path 65 is indicated by a dash-and-dot line shown in FIG. 2.

[Conveyer Roller Unit 54 and Ejection Roller Unit 55]

As depicted in FIG. 2, the conveyer roller unit 54 is disposed on a downstream side of the feeder unit 15 and on an upstream side of the recording unit 24 in the conveyer path 65 with regard to the direction of the conveyance flow 16. The conveyer roller unit 54 includes a conveyer roller 60, which is driven by the conveyer motor 102, and a pinch roller 64, which is rotated along with the rotation of the conveyer roller 60. The conveyer roller 60 and the pinch roller 61 nip the sheet 12 in there-between and convey the sheet 12 in the direction of the conveyance flow 16. Meanwhile, the ejection roller unit 55 is disposed on a downstream side of the recording unit 24 in the conveyer path 65 with regard to the direction of the conveyance flow 16. The ejection roller unit 55 includes an ejection roller 62, which is driven by the conveyer motor 102, and a spur 63, which is rotated along with the rotation of the ejection roller 62. The sheet 12 can be conveyed by the conveyer roller unit 54 and the ejection roller unit 55 along the direction of the conveyance flow 16 in the conveyer path 65.

[Platen 42]

Figure 5:
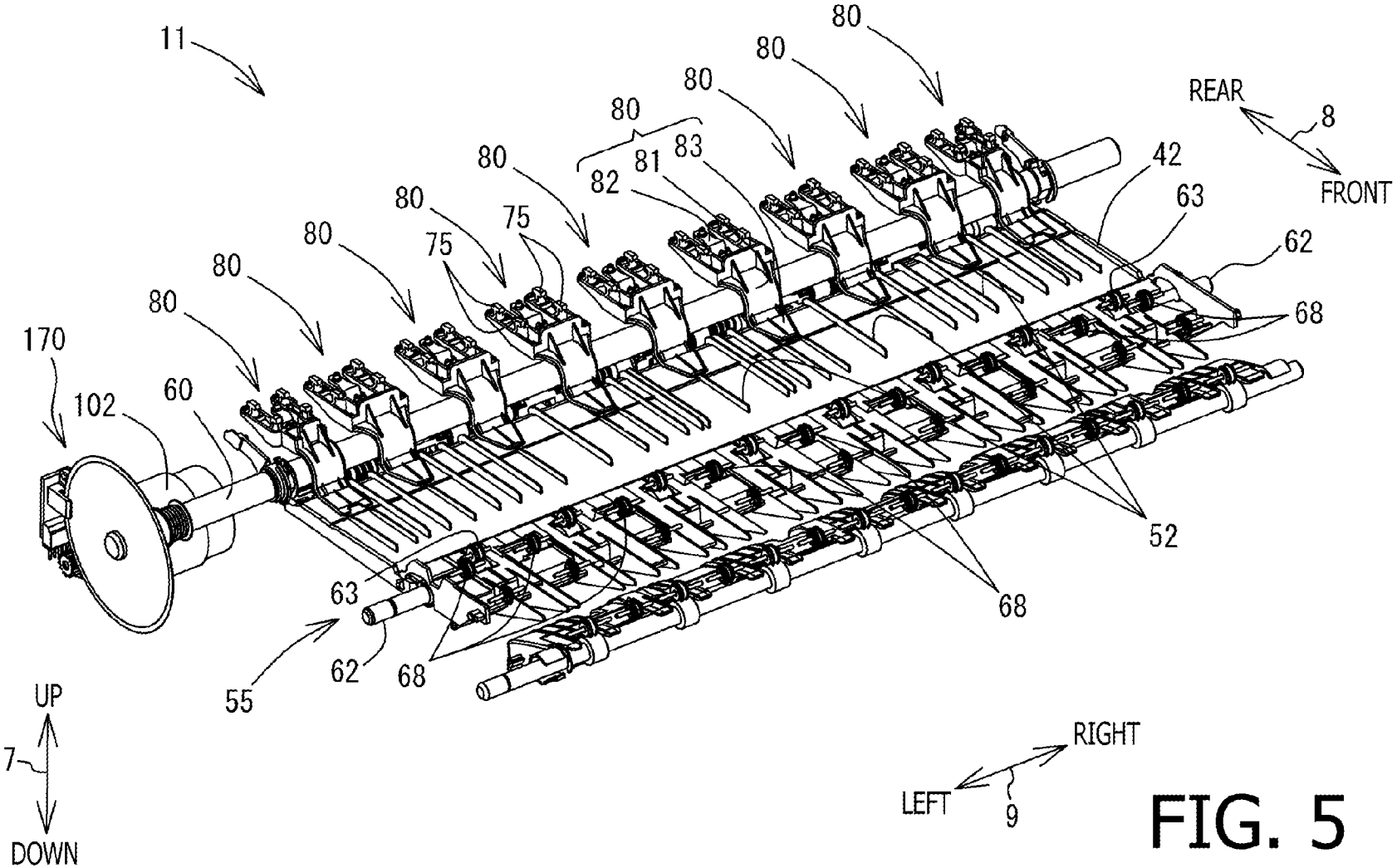
FIG. 5 is a perspective view of contact pieces 80 and a platen 42 in the MFD 10.

As depicted in FIG. 2, the platen 42 is arranged in a position between the conveyer roller unit 54 and the ejection roller unit 55 along the direction of the conveyance flow 16. The platen 42 is arranged to vertically face the recording unit 24 to support the sheet 12 being conveyed in the conveyer path 65 from below. As depicted in FIG. 5, on an upper plane of the platen 42, a plurality of supporting ribs 52 are formed to protrude upward and extend along the front-rear direction 8. The supporting ribs 52 are formed in positions spaced apart from one another along the widthwise direction 9. Therefore, the sheet 12 conveyed in the conveyer path 65 is supported by the platen 42, or, more specifically, by the plurality of ribs 52 formed on the upper plane of the platen 42.

[Recording Unit 24]

Figure 4:
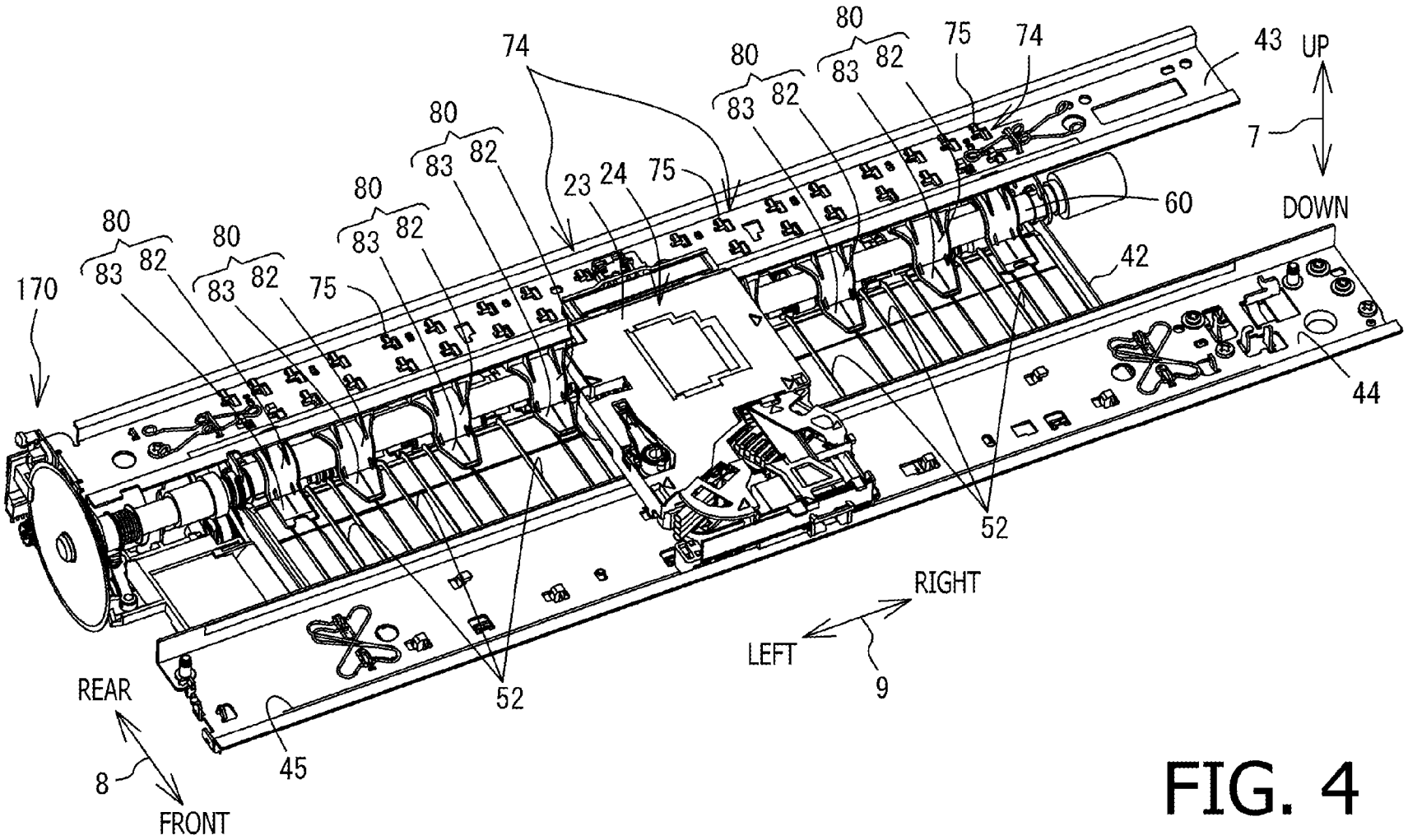
FIG. 4 is a perspective view of a recording unit 24 supported by guide rails 43, 44 in the MFD 10.

As depicted in FIG. 2, the recording unit 24 is arranged in a position between the conveyer roller unit 54 and the ejection roller unit 55 along the direction of the conveyance flow 16. In this regard, the recording unit 24 is arranged in a position to face the platen 42 on an upper side of the conveyer path 65. The recording unit 24 includes a carriage 23, an encoder sensor 38, a recording head 39, and a nozzle 40. The carriage 23 is movable along the widthwise direction 9 on the guide rails 43, 44. The encoder sensor 38 and the recording head 39 are mounted on the carriage 23. The nozzle 40 is formed on a bottom of the recording head 39. The guide rails 43, 44 are, as shown in FIG. 4, arranged to extend along the widthwise direction 9 and are spaced apart from each other along the front-rear direction 8.

The carriage 23 is driven by a driving force from a carriage motor 103 (see FIG. 7) to move in the widthwise direction 9. Orientations (e.g., leftward or rightward) of the carriage 23 to move along the widthwise direction 9 can be switched by reversing rotation of the carriage motor 103. The nozzle 40 is formed to discharge ink, which is supplied from an ink cartridge (not shown), in fine droplets there-through. Thus, the recording unit 24 discharges the ink droplets from the nozzle 40 toward the sheet 12 being supported by the platen 42 while the carriage 23 is moved in the widthwise direction 9, and thereby, an image is recorded on the sheet 12.

[Registration Sensor 160]

As depicted in FIG. 2, on an upstream side of the conveyer roller unit 54 with regard to the direction of the conveyance flow 16 in the conveyer path 65, a known registration sensor 160 is disposed. The registration sensor 160 outputs sensor signals, which vary depending on presence of the sheet 12 in a sensor position. More specifically, on condition that the sheet 12 is at the sensor position where the registration sensor 160 is disposed in the conveyer path 65, the registration sensor 160 outputs low-leveled signals to a controller 130, which will be described later in detail. Meanwhile, on condition that the sheet 12 is absent at the sensor position, the registration sensor 160 outputs high-leveled signals to the controller 130.

[Rotary Encoder 170]

The MFD 10 includes a known rotary encoder 170 (see FIG. 4), which generates pulse signals in accordance with rotation of the conveyer roller 60. The rotary encoder 170 includes an encoder disk and an encoder sensor, which are not shown. The encoder disk rotates along with rotation of the conveyer roller 60, and the optical sensor reads the rotating behavior of the encoder disk. Thus, the optical sensor generates pulse signals in accordance with rotation of the conveyer roller 60 and outputs the generated pulse signals to the controller 130.

[Linear Encoder 180]

On the guide rail 43, as shown in FIG. 4, an encoder strip 45, which extends along the widthwise direction 9, is arranged. The encoder strip 45 includes transparent portions and opaque portions, which are arranged alternately along a longitudinal direction thereof. Meanwhile, the encoder sensor 38 is mounted on the carriage 23 in a position to be able to face the encoder strip 45. While the carriage 23 is moved along the widthwise direction 9, the encoder sensor 38 detects the transparent portions and the opaque portions when passing them by and generates pulse signals according to the transparency and outputs the generated pulse signals to the controller 130. The linear encoder 180 shown in FIG. 7 includes the encoder sensor 38 and the encoder strip 45.

[Contact Pieces 80]

As shown in FIG. 2, on an upstream side of the recording head 39 with regard to the direction of the conveyance flow 16, a plurality of contact pieces 80 are arranged. As shown in FIGS. 4 and 5, the plurality of contact pieces 80 are arranged to be spaced apart from one another along the widthwise direction 9. Each contact piece 80 includes, as shown in FIGS. 2 and 5, a fixing portion 81, a curved portion 82, and a contact portion 83.

The fixing portion 81 is formed in a shape of a thin plate. The contact piece 80 is fixed to the guide rail 43 at the fixing portion 81. As shown in FIG. 5, a plurality of (e.g., four) engageable parts 75 are formed to protrude upward from an upper plane of the fixing portion 81. When the engageable parts 75 are engaged with openings 74, which are formed in the guide rail 43, the contact piece 80 is attached to a lower plane of the guide rail 43. As shown in FIG. 2, the curved portion 82 is formed to extend from the fixing portion 81 and curve lower-frontward toward the downstream of the conveyance flow 16. At the lower-front end of the curved portion 82, the contact portion 83 is formed to protrude frontward approximately along the direction of the conveyance flow 16.

The contact portion 83 is formed in a shape of a thin plate and is, as shown in FIG. 6, arranged in a position to vertically face the platen 42 along the vertical direction 7. An amount of a gap between a lower surface 84 of the contact portion 83 and the platen 42 is smaller than an amount of a gap between the bottom plane of the recording head 39 and the platen 42 but is maintained to be substantially large to allow the sheet 12 to be conveyed in there-between smoothly. Thus, the contact portion 83 is arranged in a position between the carriage 23 and the platen 42 along a direction orthogonal to the direction of the conveyance flow 16 and to the main scanning direction. In other words, the contact portion 83 is arranged in a position between the carriage 23 and the platen 42 along the vertical direction 7. On the lower surface 84 of the contact portion 83, a contact rib 85 protruding downwardly is formed. While the sheet 12 is supported by the platen 42 from below, a lower end of the contact rib 85 contacts an upper surface of the sheet 12 of the sheet 12. Thus, the sheet 12 is pressed downward toward the platen 42 by the contact portion 83 while the image may be formed on the upper surface of the sheet 12.

As shown in FIG. 6, while the plurality of supporting ribs 52 are formed to be spaced apart from one another along the widthwise direction 9, the contact portions 83 of the contact pieces 80 are arranged in between the supporting ribs 52 of the platen 42. Therefore, the supporting ribs 52 protrude toward the carriage 23 at intermediate positions between adjoining contact pieces 80, which are arranged along the widthwise direction 9. In other words, the contact ribs 85 and the supporting ribs 52 are arranged alternately along the widthwise direction 9. Meanwhile, the supporting ribs 52 are formed to protrude to be higher than the lower ends of the contact ribs 85. More specifically, the supporting ribs 52 contact the sheet 12 at positions closer to the recording head 39 than contact positions, at which the contact ribs 85 contact the sheet 12.

When the sheet 12 is in the position between the platen 42 and the contact portions 83, the sheet 12 is deformed into a corrugated shape waving up and down alternately along the widthwise direction when viewed from an upstream or a downstream position along the conveyance flow 16. Downstream ends of the contact ribs 85 along the direction of the conveyance flow 16 are on a downstream position side of the conveyer roller unit 54 and on upstream position side of the recording head 39 with regard to the direction of the conveyance flow 16. Thus, the contact pieces 80 and the supporting ribs 52 on the platen 42 serve as a corrugation mechanism, which forms the corrugated shape in the sheet 12, and the corrugation mechanism is arranged in an area containing a corrugating position, which is between the conveyer roller unit 54 and the recording head 39.

[Corrugating Spurs 68]

The corrugating spur 68 is, as depicted in FIGS. 2 and 5, disposed on a downstream side of the ejection roller unit 55 with regard to the direction of the conveyance flow 16. The corrugating spur 68 includes, as shown in FIG. 5, a plurality of corrugating spurs 68, which are arranged to align along the widthwise direction 9 to be spaced apart from one another. The corrugating spurs 68 are arranged in lower positions than the spurs 63 in the ejection roller unit 55 with regard to height in the vertical direction 7. Thus, the corrugating spurs 68 contact the upper surface of the sheet 12. The corrugating spurs 68 are arranged in substantially coincident widthwise positions with the contact pieces 80. In other words, each contact piece 80 and each corrugating spur 68 are arranged in a line along the front-rear direction 9. Therefore, the corrugating spurs 68 contact substantially same areas in the sheet 12 as the contact pieces 80. The corrugating spurs 68 serve as a part of the corrugation mechanism in the MFD 10. The position, where the corrugating spurs 68 and the sheet 12 contact each other, may be referred to as the corrugating position according to the present embodiment and is on a downstream side of the ejection roller unit 55 with regard to the direction of the conveyance flow 16.

Thus, the contact pieces 80 and the supporting ribs 52 on the platen 42 serve to form the corrugated shape in the sheet 12 at a portion where the sheet 12 faces the recording head 39. In particular, the corrugated shape has peaks 12A of protrusive mountain portions, protruding from a predetermined reference level, and bottoms 12B of recessed valley portions, recessed from the reference level. And each of the peaks 12A of protrusive mountain portions and each of the bottoms 12B of recessed valley portions are positioned alternately along the widthwise direction 9. More specifically, the peak 12A refers to a position of boundary point, at which tendency of the amount of the gap between the recording head 39 and the sheet 12 along the widthwise direction 9 is turned from decreasing to increasing, in the protrusive mountain portion. When the sheet 12 is in a position between the platen 42 and the contact pieces 80, the positions of the peaks 12A substantially coincide with the positions of the supporting ribs 52 on the platen 42. The bottom 12B refers to a position of a boundary point, at which the tendency of the amount of the gap between the recording head 39 and the sheet 12 along the widthwise direction 9 is turned from increasing to decreasing, in the recessed valley portion. Therefore, when the sheet 12 is in a position between the platen 42 and the contact pieces 80, the positions of the bottoms 12B substantially coincide with the contact ribs 85 of the contact pieces 80 and the corrugating spurs 68. Intermediate portions between the peaks 12A and the bottoms 12B form curves, which can be approximately expressed in a cubic function.

Meanwhile, in the present embodiment, as depicted in FIG. 4, the contact pieces 80 are arranged at nine (9) positions along the widthwise direction 9 to be spaced apart from one another. As mentioned above, the bottoms 12B of the sheet 12 are formed in the positions where the contact ribs 85 of the contact pieces 80 are arranged. Therefore, nine (9) bottoms 12B are formed in the sheet 12. In this regard, in order to avoid widthwise ends of the sheet 12 from being contacted by the recording head 39, the sheet 12 is deformed to have the widthwise ends thereof to form the bottoms 12B, to be apart from the recording head 39. Therefore, while each peak 12A is formed in between mutually adjoining two bottoms 12B, eight (8) peaks 12A are formed in the sheet 12. According to the present embodiment, a position of one of the bottoms 12B at a widthwise center, i.e., a fifth bottom 12B from the right and left along the widthwise direction 9, is referred to as a reference position. Generally, the reference position substantially coincides with a widthwise center of the sheet 12.

[Controller 130]

As depicted in FIG. 7, the controller 130 includes a CPU (central processing unit) 131, a ROM (read-only memory) 132, a RAM (random access memory) 133, an EEPROM (electrically erasable programmable read-only memory) 134, and an ASIC (application specific integrated circuits) 135, which are connected with one another by internal busses 137. The ROM 132 stores programs to control behaviors of the CPU 131. The RAM 133 is used as a memory area to temporarily store data and signals to be used in cooperation with the programs stored in the ROM 132 and as a work area to process the data. The EEPROM 134 stores data, such as configuration data and flags, which is to be saved even after power to the controller 130 is shut down.

The ASIC 135 is connected with the conveyer motor 102, the carriage motor 103 and the recording head 39. The ASIC 135 obtains driving signals to drive the conveyer motor 102 and the carriage motor 103 from the CPU 131 and outputs driving current to the conveyer motor 102 and the carriage motor 103 according to the driving signals. The conveyer motor 102 and the carriage motor 103 are driven by the driving current. For example, the controller 130 may control the conveyer motor 102 to rotate the rollers. At the same time, the controller 130 may control the carriage motor 103 to reciprocate the carriage 23. Further, the controller 130 may control the recording head 39 to discharge the ink through the nozzles 40.

The ASIC 135 is electrically connected with the registration sensor 160, the rotary encoder 170, and the linear encoder 180. Based on the detected signals output from the registration sensor 160 and the pulse signals output from the rotary encoder 170, the controller 130 detects a position of the sheet 12 in the conveying path 65. Further, based on the pulse signals obtained from the linear encoder 180, the controller 130 detects a position of the carriage 23 along the widthwise direction 9.

[Image Recording Operation]

With reference to FIG. 8, a flow of image recording operation executed by the MFD 10 will be described herein below. The flow described below may be executed by the CPU 131 reading the program from the ROM 132 or may be achieved by hardware circuits mounted on the controller 130.

The controller 130 starts the flow shown in FIG. 8 on condition that an image recording instruction is entered by the user. The image recording instruction may be obtained from, but not limited to, an operation panel (not shown) provided in the MFD 10, for example. For another example, the instruction may be entered from an external device through a communication network. The image recording instruction causes the controller 130 to drive the components including the rollers 25, 60, 62, the carriage 23, and the recording head 39, to record an image on the sheet 12. The image recording instruction may include, for example, image data, sheet-type information, and fiber-alignment information. The image data may be data representing the image to be recorded on the sheet 12. The sheet-type information may indicate a type of the sheet 12 (e.g., regular paper or glossy paper) to be used in the image recording operation. The fiber-alignment information may indicate an orientation (e.g., crosswise or lengthwise) of fiber contained in the sheet 12 to be used.

[Feeding Step (S11)]

When the image recording instruction is entered, in S11, the controller 130 conducts a feeding step to feed the sheet 12 supported by the feeder tray 20 to a recording-start position. More specifically, the controller 130 controls feeding of the sheet 12 from the feeder tray 20 by activating the conveyer motor 102 and thereby rotates the feed roller 25, and controls conveying of the sheet 12 to the recording-start position by activating the conveyer motor 102 and thereby rotates the conveyer roller 60. The recording-start position refers to a position, at which an area for forming an initial part of the image in the sheet 12 and the nozzles 40 of the recording head 39 confront each other. The controller 130 may determine that the sheet 12 reaches the conveyer roller unit 54 and the recording-start position based on combination of the detected signals output from the registration sensor 160 to the controller 130 and the pulse signals output from the rotary encoder 170 to the controller 130. In the feeding step in S11 and a conveying step in S18, which will be described below, the sheet 12 is conveyed for a predetermined linefeed amount along the direction of the conveyance flow 16.

[Detecting Step (S12)]

Next, in S12, the controller 130 conducts a detecting step, in which a position of a tail end of the sheet 12 conveyed in the feeding step (S11) or in the conveying step (S18) is detected. The tail end of the sheet 12 refers to an upstream end of the sheet 12 being conveyed with regard to the direction of the conveying flow 16. In S12, more specifically, the controller 130 detects the position of the tail end of the sheet 12 based on combinations of the detected signals output from the registration sensor 160 and the pulse signals output from the rotary encoder 170. In S13, the controller 130 determines a step to conduct among recording steps A (S14), B (S15), and C (S16) depending on the detected position of the tail end of the sheet 12 with respect to positions A and B (see FIG. 2). The position A shown in FIG. 2 is a nipping position, in which the conveyer roller unit 54 can nip the sheet 12. The position B shown in FIG. 2 is the position of the downstream ends of the contact ribs 85 with regard to the direction of the conveyance flow 16, i.e., the corrugating position.

Among the recording steps A-C, the controller 130 conducts the recording step A in S14 on condition that the lower-leveled signals are output from the registration sensor 160, that is, if the tail end of the sheet 12 has not passed through the conveyer roller unit 54. In other words, when the tail end of the sheet 12 is on the upstream side of the position A with regard to the direction of the conveyance flow 16 (S13: the tail end≤A), the flow proceeds from S13 to S14. In this regard, the controller 14 counts a number of pulse signals, which are output from the rotary encoder 170 from a point when the signals output from the registration sensor 160 change from the low-leveled signals to the high-leveled signal. On condition that the counted number of the pulse signals is smaller than a first threshold, the controller 130 executes the recording step A in S14. At this moment, the tail end of the sheet 12 has not passed through the conveyer roller unit 54 (S13: the tail end≤A). The first threshold is a value, which indicates a distance between the sensor position of the registration sensor 160 and the position A along the conveyance flow 16 or a count of the pulse signals corresponding to the distance.

Meanwhile, among the recording steps A-C, the controller 130 conducts the recording step B in S15 on condition that the counted number of pulse signals indicates a value greater than or equal to the first threshold and smaller than a second threshold. In this regard, the second threshold is greater than the first threshold. That is, when the tail end of the sheet 12 has passed through the conveyer roller unit 54 but not has passed through the corrugating position yet, the controller 130 conducts the recording step B in S15. In other words, when the tail end of the sheet 12 is between the position A and the position B with regard to the conveyance flow 16 (S13: A<tail end≤B), the controller 130 conducts the recording step B in S15. On the other hand, on condition that the counted number of the pulse signals is greater than or equal to the second threshold, the controller 130 conducts the recording step C in S16, which will be described below. That is, when the tail end of the sheet 12 has passed through the corrugating position, the controller 130 conducts the recording step in S16. In other words, when the tail end of the sheet 12 is on a downstream side of the position B with regard to the conveyance flow 16 (S13: B<tail end), the controller 130 conducts the recording step C. In this regard, the second threshold is a value, which indicates a distance between the sensor position of the registration sensor 160 and the position B along the conveyance flow 16 or a count of the pulse signals corresponding to the distance.

[Recording Steps (S14-S16)]

Following S13, the controller 130 conducts one of the recording steps S14-S16, in which the controller 130 manipulates the carriage motor 103 to move the carriage 23 in the widthwise direction 9 and the recording head 39 to discharge the ink at predetermined discharging timings. In this regard, the discharging timings to discharge the ink at a same targeted position vary among the recording steps A, B, C.

The recording steps A-C in S14-S16 to be conducted by the controller 130 will be described with reference to FIGS. 9-12. In FIG. 9 and upper rows in FIGS. 10-11, a corrugated shape of the sheet 12 along the widthwise direction 9 while the tail end has not passed through the conveyer roller unit 54 yet in S13 (S13: tail end≤A) is illustrated. A lower row in FIG. 10 shows a shape of the sheet 12 while the sheet 12 is under the condition where the tail end has passed through the conveyer roller unit 54 but has not passed through the corrugating position yet (S13: A<tail end≤B). A lower row in FIG. 11 shows a shape of the sheet 12 while the sheet 12 is under the condition where the tail end has passed through the corrugating position (S13: B<tail end). In the following description, behaviors of the controller 130 with regard to the carriage 23 traveling in the forward orientation FWD (e.g., rightward) will be described. However, the behaviors of the controller 130 with regard to the carriage 23 traveling in a reverse orientation RVS (e.g., leftward), which is from the right-hand side toward the left-hand side, can be similarly explained by reversing the right and the left.

[Recording Step A (S14)]

In the MFD 10 according to the present embodiment, when the ink droplet discharged from the recording head 39 is landed at a specific targeted position on the sheet 12, it is necessary that the controller 130 controls the nozzle 40 to discharge the ink droplet before the nozzle 40 reaches a position straight above the targeted position in consideration of time lag required for the discharged ink to travel through the gap between the nozzle 40 and the sheet 12. Further, it is noted that the sheet 12 conveyed to the recording-start position in the corrugation mechanism is deformed in the corrugated shape with the peaks 12A and the bottoms 12B as indicated in a solid corrugating line shown in FIG. 9. In other words, as the recording head 39 is moved along the widthwise direction 9, the amount of the gap between the nozzle 40 and the sheet 12 fluctuates to be larger and smaller in the vertical direction 7 alternately. Therefore, it is necessary that the controller 130 adjust the discharging timings of the ink in consideration of the amount of fluctuated gap. For example, the controller 130 adjusts the discharging timing of the ink to be delayed later as the amount of the gap is smaller, and meanwhile, the controller 130 adjusts the discharging timing of the ink to be advanced earlier as the amount of the gap is larger.

Therefore, the controller 130 determines timings to discharge the ink toward a targeted position on each peak 12A and each bottom 12B on the sheet P respectively in consideration of the amount of gap fluctuation. More specifically, the controller 130 obtains a reference value D0, peak deviation values Y(m), which correspond to the peaks 12A respectively, and bottom deviation values Y(m+1), which correspond to the bottoms 12B respectively, from the EEPROM 134. The values to be obtained from the EEPROM 134 may be achieved from experiments and/or simulations and factory-installed in the EEPROM 134 prior to shipping of the MFD 10.

[Reference Value D0]

The reference value D0 indicates a reference timing for the ink to be discharged to land on a reference landing position Ls on the sheet 12. More specifically, the reference value D0 indicates a time period, which is required for the ink discharged from the nozzle 40 to land on a reference landing position Ls. The reference landing position Ls is set in a center position 12C between a mutually adjoining peak 12A and bottom 12B (i.e., a level of the sheet 12 when amplitude is zero) along the vertical direction 7, i.e., a direction along which the recording head 39 and the sheet 12 face each other. Meanwhile, the reference value D0 also corresponds to a time period, which is required by the carriage 23 (more specifically, the recording head 39) to move from a reference discharging position Es to a position straight above the reference landing position Ls. Therefore, when a moving velocity of the carriage 23 is expressed by "V", a distance between the reference discharging position Es and the reference landing position Ls along the widthwise direction 9 is expressed as D0*V. In the following description, when the position of the carriage 23 is referred to, it may be interpreted as a position of the recording head 39.

For example, when the carriage 23 moving in the forward orientation FWD reaches the reference discharging position Es and discharges the ink from the recording head 39 thereat, the ink lands on the reference landing position Ls on the sheet 12 after D0 second, i.e., after the time period indicated by the reference value D0. Meanwhile, the carriage 23 reaches the position straight above the reference landing position Ls D0 second after the discharge of the ink at the reference discharging position Es. In other words, in order for the discharged ink to land on the reference landing position Ls, the ink should be discharged D0 second before the carriage 23 reaches the position straight above the reference landing position Ls, i.e., when the carriage 23 is at the reference discharging position Es. Thus, the reference value D0 specifies the discharging timing for the ink to be discharged and land on the intermediate position C (i.e., on the reference landing position Es).

The above-mentioned center position 12C may not necessarily be limited to the vertically center position between the mutually adjoining peak 12A and bottom 12B. For example, the center position 12C may be set at an average level between one of the peaks 12A closest to the recording head 39 along the vertical direction 7 and one of the bottoms 12B farthest from the recording head 39 along the vertical direction 7. For another example, the center position 12C may be set at an average level between an average level among levels of the plurality of peaks 12A and an average level among levels of the plurality of bottoms 12B along the vertical direction 7. The reference value D0 is commonly applied to every targeted position on the sheet 12. Meanwhile, the reference value D0 may not necessarily be limited to the example described above but may include, for example, a plurality of reference values. For example, a first reference value, which is used when the discharging timings for the ink to be discharged to land on the peaks 12A are determined, and a second reference value, which is used when the discharging timings for the ink to be discharged to land on the bottoms 12B are determined, may be included and stored in the EEPROM 134.

[Peak Deviation Value Y(m)]

An example, when the recording head 39 discharges the ink toward the peak 12A on the sheet 12, indicated by the solid corrugating line in FIG. 9, will be described. While the carriage 23 is moving in the forward orientation FWD along the widthwise direction 9, the recording head 39 targets the ink to land on the peak 12A and discharges the ink D0 second before the carriage 23 reaches the position straight above the peak 12A at the reference discharging position Es. In this regard, however, the ink lands on an upstream (leftward) position than the targeted peak 12A with regard to the forward orientation FWD (rightward), at a landing position LA1. Thus, a distance a1 between the reference discharging position Es and the landing position LA1 along the widthwise direction 9 is smaller than a distance a (i.e., D0*V) between the reference discharging position Es and the targeted peak 12A along the widthwise direction 9 (distance a1<distance a). A deviated amount between the distance a1 and the distance a is represented by the peak deviation value Y(m).

Therefore, it is necessary that the controller 130 manipulates the recording head 39 to discharge the ink targeted at the peak 12A at a peak-targeted discharging position Ea (see FIG. 9), which is deviated from the reference discharging position Es upstream with regard to the forward orientation FWD for the amount indicated by the peak deviation amount Y(m). Thus, the peak deviation value Y(m) indicates the distance between the reference discharging position Es, at which the recording head 39 should discharge the ink toward the center position 12C, and the peak-targeted discharging position Ea, at which the recording head 39 should discharge the ink toward the peak 12A, along the widthwise direction 9. Namely, the peak deviation value Y(m), which specifies the discharging timing for the ink to be discharged to land on the peak 12A, is obtained by correctly delaying the discharging timing for the ink to be discharged at the center position 12C, which is specified by the reference value D0. In other words, the peak deviation value Y(m), which is obtained by correcting the reference discharging position Es, provides the peak-targeted discharging position Ea.

[Bottom Deviation Value Y(m+1)]

An example, when the recording head 39 discharges the ink at the bottom 12B on the sheet 12, indicated by the solid corrugating line in FIG. 9, will be described. While the carriage 23 is moving in the forward orientation FWD along the widthwise direction 9, the recording head 39 targets the ink to land on the bottom 12B and discharges the ink D0 second before the carriage 23 reaches the position straight above the bottom 12B at the reference discharging position Es. In this regard, however, the ink lands on a downstream (rightward) position with respect to the targeted bottom 12B with regard to the forward orientation FWD (rightward) of the carriage 23 along the widthwise direction 9, at a landing position LB1. Thus, a distance b1 between the reference discharging position Es and the landing position LB1 along the widthwise direction 9 is greater than a distance b (i.e., D0*V) between the reference discharging position Es and the targeted bottom 12B along the widthwise direction 9 (distance b1>distance b). A deviated amount between the distance b1 and the distance b is represented by the bottom deviation value Y(m+1).

Therefore, it is necessary that the controller 130 manipulates the recording head 39 to discharge the ink targeted at the bottom 12B at a bottom-targeted discharging position Eb (see FIG. 9), which is displaced from the reference discharging position Es downstream with regard to the forward orientation FWD for the amount indicated by the bottom deviation value Y(m+1). Thus, the bottom deviation value Y(m+1) indicates the distance between the reference discharging position Es, at which the recording head 39 should discharge the ink toward the center position 12C, and the bottom-targeted discharging position Eb, at which the recording head 39 should discharge the ink toward the bottom 12B, along the widthwise direction 9. Namely, the bottom deviation value Y(m+1), which specifies the discharging timing for the ink to be discharged to land on the bottom 12B, is obtained by correctly advancing the discharging timing for the ink to be discharged to at the center position 12C, which is specified by the reference value D0. In other words, the bottom deviation value Y(m+1), which is obtained by correcting the reference discharging position Es, provides the bottom-targeted discharging position Eb.

[Correction of Discharging Timings by Peak and Bottom Deviation Values]

Therefore, a length of the time required for the carriage 23 to travel the distance corresponding to the peak deviation value Y(m) or the bottom deviation value Y(m+1) is obtained by dividing the peak deviation value Y(m) or the bottom deviation value Y(m+1) by the moving velocity V of the carriage 23. Namely, the discharging timing targeted at the peak 12A is expressed as D0+Y(m)/V, and the discharging timing targeted at the bottom 12B is expressed as D0+Y(m+1)/V. Thus, by shifting the discharging timing targeted at the peak 12A or the bottom PB from the reference value D0, the ink is discharged to land on the targeted peak 12A or bottom 12B. Having mentioned that, however, in the present embodiment, the peak deviation value Y(m) and the bottom deviation value Y(m+1) divided by the moving velocity V are further multiplied by ½, in consideration of results obtained from experiments and simulations, and added to the reference value D0 respectively.

Accordingly, in the recording step A in S14, the controller 130 manipulates the recording head 39 to discharge the ink to land on the targeted peaks 12A at the discharging timings (D0+Y(m)/2V) and the ink to land on the targeted bottoms 12B at the discharging timings (D0+Y(m+1)/2V). Thus, the discharging timing for the ink to be discharged to land on the targeted peak 12A (i.e., the peak-targeted discharging position Ea) is specified by the combination of the reference value D0, the peak deviation value Y(m), and the moving velocity V of the carriage 23. Meanwhile, the discharging timing for the ink to be discharged to land on the targeted bottom 12B (i.e., the bottom-targeted discharging position Eb) is specified by the combination of the reference value D0, the bottom deviation value Y(m+1), and the moving velocity V of the carriage 23.

In this regard, values D specifying the discharging timings for the targeted peak 12A and the targeted bottom 12B are represented in an expression D=D0+Y(m)/2V and an expression D=D0+Y(m+1)/2V respectively. In this regard, the value D indicates that the ink is to be discharged D second(s) before the carriage 23 reaches the position straight above the targeted position. Therefore, the greater the value D is, the earlier the discharging timing is advanced to be. Meanwhile, the smaller the value D is, the discharging timing is delayed to be later. Accordingly, when the reference value D0 being a positive value is provided, Y(m)/2V being a negative value, of which absolute value is smaller than the reference value D0, and Y(m+1)/2V being a positive value are achieved.

As mentioned above, the sheet 12 is deformed to have eight (8) peaks 12A and nine (9) bottoms 12B. Meanwhile, the EEPROM 134 stores the reference value D0, eight peak deviation values Y(2), Y(4), Y(6), Y(8), Y(10), Y(12), Y(14), Y(16), which correspond to one of the eight peaks 12A respectively, and nine bottom deviation values Y(1), Y(3), Y(5), Y(7), Y(9), Y(11), Y(13), Y(15), Y(17), which correspond to one of the nine bottoms 12B respectively, therein. Further, the EEPROM 134 stores adjusting values α(1) through (17) and adjusting values β(1) through (17). In the present embodiment, when the peak deviation value for one of the peaks 12A is represented by a sign Y(m), the bottom deviation value for one of the bottoms 12B formed on a right-hand side neighboring position with respect to the one of the peaks 12A is represented by a sign Y(m+1). Moreover, both of the peak deviation value for the peak 12A and the bottom deviation value for the bottom 12B on an upstream side of the reference position Ps with regard to the forward orientation FWD are represented by the signs Y(m) and Y(m+1) respectively. Meanwhile, both of the peak deviation value for the peak 12A and the bottom deviation value for the bottom 12B on a downstream side of the reference position Ps with regard to the forward orientation FWD are represented by the signs Y(n) and Y(n+1) respectively.

[Recording Step B (S15)]

The shape of the sheet 12 along the widthwise direction 9 changes depending on the position of tail end in the conveyance flow 16, i.e., before the tail end of the sheet 12 passing through the position A (see the upper row in FIG. 10) and after the tail end of the sheet 12 passing through the position A and in a position between the positions A and B (see the lower row in FIG. 10). In particular, as shown in the lower row in FIG. 10, peaks 12A' and bottoms 12B', excluding the bottom 12B' at the reference position Ps on a dash-and-dot line shown in FIG. 10, are shifted along the widthwise direction 9 to positions displaced from the peaks 12A and the bottoms 12B shown in the upper row in FIG. 10 to be closer to the reference position Ps respectively. In this regard, amounts for the peaks 12A' and the bottoms 12B' to be displaced with respect to the corresponding peaks 12A and the bottoms 12B are enlarged to be larger as the peaks 12A' and the bottoms 12B' are farther from the reference position Ps along the widthwise direction 9. In other words, the peaks 12A' and the bottoms 12B' on the upstream side of the reference position Ps with regard to the forward orientation FWD are displaced to downstream positions with respect to the corresponding peaks 12A and the bottoms 12B respectively, and the farther the peaks 12A' and the bottoms 12B' are apart from the reference position Ps along the widthwise direction, the larger the displaced amounts for the peaks 12A' and the bottoms 12B' are enlarged from the corresponding peaks 12A and the bottoms 12B respectively. Meanwhile, the peaks 12A' and the bottoms 12B' on the downstream side of the reference position Ps with regard to the forward orientation FWD are displaced to upstream positions with respect to the corresponding peaks 12A and the bottoms 12B respectively, and the farther the peaks 12A' and the bottoms 12B' are apart from the reference position Ps along the widthwise direction 9, the larger the displaced amounts for the peaks 12A' and the bottoms 12B' are enlarged from the corresponding peaks 12A and the bottoms 12B respectively.

In this regard, the recording head 39 discharges the ink toward the peak 12A' on the sheet 12 at a corrected peak-targeted discharging position Ea' (see the lower row FIG. 10), which is displaced from the peak-targeted discharging position Ea in a direction to be closer to the reference position Ps, and the recording head 39 discharges the ink toward the bottom 12B' on the sheet 12 at a corrected bottom-targeted discharging position Eb' (see the lower row in FIG. 10), which is displaced from the reference discharging position Eb in the direction to be closer to the reference position Ps. In order to correct the peak-targeted discharging position Ea into the corrected peak-targeted discharging position Ea' and the bottom-targeted discharging position Eb into the corrected bottom-targeted discharging position Eb', an adjusting value $\alpha$ is applied.

The EEPROM 134 stores a plurality of first adjusting values $\alpha(1)$ through $\alpha(17)$, which are used to correct the peak deviation value Y(m) for each peak 12A and the bottom deviation value Y(m+1) for each bottom 12B in the recording step B. In FIG. 12, the deviation values Y and the adjusting value $\alpha$ associated with one another are indicated by same reference numerals placed in parentheses. The first adjusting value $\alpha$ is a value, which affects the peak deviation value Y(m) and the bottom deviation value Y(m+1) to be increased, for a greater amount as the peak 12A' and the bottom 12B' are located in farther positions apart from the reference position Ps toward the upstream side with regard to the forward orientation FWD; and affects the peak deviation value Y(m) and the bottom deviation value Y(m+1) to be decreased, for a greater amount as the peak 12A' and the bottom 12B' are located in farther positions apart from the reference position Ps toward the downstream side with regard to the forward orientation FWD. In particular, with regard to the adjusting values $\alpha(1)$ through $\alpha(8)$, which are values to be applied to the peaks 12A' and the bottoms 12B' formed on the upstream side of the reference position Ps with regard to the forward orientation FWD, the farther the peaks 12A' and bottoms 12B' are apart from the reference position Ps, the greater adjusting values $\alpha(1)$ through $\alpha(8)$ are applied to the peak adjusting values Y(m) and the bottom adjusting values Y(m+1). In this regard, the adjusting values $\alpha(1)$ through $\alpha(8)$ are greater than or equal to zero (0). Meanwhile, with regard to the adjusting values $\alpha(10)$ through $\alpha(17)$, which are values to be applied to the peaks 12A' and the bottoms 12B' formed on the downstream side of the reference position Ps with regard to the forward orientation FWD, the farther the peaks 12A' and bottoms 12B' are apart from the reference position Ps, the smaller adjusting values $\alpha(10)$ through (17) are applied to the peak adjusting values Y(m) and the bottom adjusting values Y(m+1). In this regard, the adjusting values $\alpha(10)$ through $\alpha(17)$ are smaller than or equal to zero (0). Meanwhile, the adjusting value $\alpha(9)$ corresponding to the reference position Ps is zero (0). Largeness or smallness of the adjusting values $\alpha(1)$ through $\alpha(17)$ can be expressed in an inequality: $\alpha(1)\geq\alpha(2)\geq\alpha(3)\geq\alpha(4)\geq\alpha(5)\geq\alpha(6)\geq\alpha(7)\geq\alpha(8)\geq\alpha(9)\geq\alpha(10)\geq\alpha(11)\geq\alpha(12)\geq\alpha(13)\geq\alpha(14)\geq\alpha(15)\geq\alpha(16)\geq\alpha(17)$. In the present embodiment, the adjusting values $\alpha$, which are used to adjust the peak deviation values (Y) and the bottom deviation values Y(m+1) for the peaks 12A' and the bottoms 12B' formed on the upstream side of the reference position Ps with regard to the forward orientation FWD may be represented by $\alpha(m)$; and the adjusting values $\alpha$, which are used to adjust the peak deviation values (Y) and the bottom deviation values Y(n+1) for the peaks 12A' and the bottoms 12B' formed on the downstream side of the reference position Ps with regard to the forward orientation FWD may be represented by $\alpha(n)$.

Thus, the discharging timings for the recording head 39 to discharge the ink in the recording step B in S15 are obtained by adjusting the peak deviation values Y(m) and the bottom deviation values Y(m+1), which are adjusted by applying the adjusting value $\alpha$ and deviating the adjusted peak deviation values Y(m) and the bottom deviation values Y(m+1), from the reference value D0 respectively. In particular, the peak deviation values Y(m) and the bottom deviation values Y(m+1) are adjusted by adding the adjusting values $\alpha$. Therefore, in the recording step B in S15, the discharging timings are obtained by dividing the adjusted peak deviation values Y(m) and the adjusted bottom deviation values Y(m+1) by the moving velocity V of the carriage 39, multiplying the divided quotient by ½, and adding the multiplied value to the reference value D0.

Thus, in the recording step B in S15, the discharging timings to discharge the ink toward the peaks 12A' formed on the upstream side of the reference position Ps with regard to the forward orientation FWD, i.e., the corrected peak-targeted discharging positions Ea', are expressed as $D0+(Y(m)+\alpha(m))/2V$; and the discharging timings to discharge the ink toward the bottoms 12B' formed on the upstream side of the reference position Ps with regard to the forward orientation FWD, i.e., the corrected bottom-targeted discharging positions Eb', are expressed as $D0+(Y(m+1)+\alpha(m+1))/2V$. Meanwhile, the discharging timings to discharge the ink toward the peaks 12A' formed on the downstream side of the reference position Ps with regard to the forward orientation FWD, i.e., the corrected peak-targeted discharging positions Ea', are expressed as $D0+(Y(n)+\alpha(n))/2V$; and the discharging timings to discharge the ink toward the bottoms 12B' formed on the downstream side of the reference position Ps with regard to the forward orientation FWD, i.e., the corrected bottom-targeted discharging positions Eb', are expressed as $D0+(Y(n+1)+\alpha(n+1))/2V$.

Therefore, the controller 130 manipulates the recording head 39 to discharge the ink toward the peaks 12A' formed on the upstream side of the reference position Ps with regard to the forward orientation FWD at the discharging timings $D0+(Y(m)+\alpha(m))/2V$, and toward the bottoms 12B' formed on the upstream side of the reference position Ps with regard to the forward orientation FWD at the discharging timings $D0+(Y(m+1)+\alpha(m+1))/2V$. Meanwhile, the controller 130 manipulates the recording head 39 to discharge the ink toward the peaks 12A' formed on the downstream side of the reference position Ps with regard to the forward orientation FWD at the discharging timings $D0+(Y(n)+\alpha(n))/2V$, and toward the bottoms 12B' formed on the downstream side of the reference position Ps with regard to the forward orientation FWD at the discharging timings $D0+(Y(n+1)+\alpha(n+1))/2V$. Thus, in the recording step B in S15, as shown in FIG. 10, the inks targeted at the positions on the upstream side of the reference position Ps with regard to the forward orientation FWD are discharged in delayed discharging timings compared to the discharging timings in the recording step A in S14, and the inks targeted at the positions on the downstream side of the reference position Ps with regard to the forward orientation FWD are discharged in advanced discharging timings compared to the discharging timings in the recording step A in S14.

Thus, the expressions $D0+(Y(m)+\alpha(m))/2V$, $D0+(Y(m+1)+\alpha(m+1))/2V$, $D0+(Y(n)+\alpha(n))/2V$, and $D0+(Y(n+1)+\alpha(n+1))/2V$ represent the discharging timings in the recording step B in S15. The reference value D0; the peak deviation values Y(m), Y(n); the adjusting values $\alpha(m)$, $\alpha(n)$; and the moving velocity V of the carriage 39 are used to obtain the discharging timings (i.e., the corrected peak-targeted discharging positions Ea') to discharge the ink so that the ink should land on the peaks 12A'. The reference value D0; the peak deviation values Y(m+1), Y(n+1); the adjusting values $\alpha(m+1)$, $\alpha(n+1)$; and the moving velocity V of the carriage 39 are used to obtain the discharging timings (i.e., the corrected bottom-targeted discharging positions Eb') to discharge the ink so that the ink should land on the bottoms 12B'.

[Recording Step C (S16)]

The shape of the sheet 12 along the widthwise direction 9 changes depending on the position of tail end in the conveyance flow 16, i.e., before the tail end of the sheet 12 passing through the position A (see the upper row in FIG. 11) and after the tail end of the sheet 12 passing through the position B (see the lower row in FIG. 11). In particular, as shown in the lower row in FIG. 11, peaks 12A" and bottoms 12B", excluding the bottom 12B" at the reference position Ps on a dash-and-dot line shown in FIG. 11, are shifted along the widthwise direction 9 to positions displaced to be away from the peaks 12A and the bottoms 12B shown in the upper row in FIG. 11 respectively. In this regard, amounts for the peaks 12A" and the bottoms 12B" to be displaced with respect to the corresponding peaks 12A and the bottoms 12B are enlarged to be greater as the peaks 12A" and the bottoms 12B" are farther from the reference position Ps. In other words, the peaks 12A" and the bottoms 12B" on the upstream side of the reference position Ps with regard to the forward orientation FWD are displaced to the farther upstream positions with respect to the corresponding peaks 12A and the bottoms 12B respectively, and the farther the peaks 12A" and the bottoms 12B" are apart from the reference position Ps, the larger the displaced amounts for the peaks 12A" and the bottoms 12B" are enlarged from the corresponding peaks 12A and the bottoms 12B respectively. Meanwhile, the peaks 12A" and the bottoms 12B" on the downstream side of the reference position Ps with regard to the forward orientation FWD are displaced to the farther downstream positions with respect to the corresponding peaks 12A and the bottoms 12B respectively, and the farther the peaks 12A" and the bottoms 12B" are apart from the reference position Ps, the larger the displaced amounts for the peaks 12A" and the bottoms 12B" are enlarged from the corresponding peaks 12A and the bottoms 12B respectively.

In this regard, the recording head 39 discharges the ink toward the peak 12A" on the sheet 12 at a corrected peak-targeted discharging position Ea" (see the lower row FIG. 11), which is displaced from the peak-targeted discharging position Ea in a direction to be farther from the reference position Ps, and the recording head 39 discharges the ink toward the bottom 12B" on the sheet 12 at a corrected bottom-targeted discharging position Eb" (see the lower row in FIG. 11), which is displaced from the bottom-targeted discharging position Eb in the direction to be farther from the reference position Ps. In order to correct the peak-targeted discharging position Ea into the corrected peak-targeted discharging position Ea" and the bottom-targeted discharging position Eb into the corrected bottom-targeted discharging position Eb", an adjusting value $\beta$ is applied.

The EEPROM 134 stores a plurality of adjusting values $\beta(1)$ through $\beta(17)$, which are used to correct the peak deviation value Y(m) for each peak 12A and the bottom deviation value Y(m+1) for each bottom 12B in the recording step C. In FIG. 12, the deviation values Y and the adjusting value $\beta$ associated with one another are indicated by same reference numerals placed in parentheses. The adjusting value $\beta$ is a value, which affects the peak deviation value Y(m) and the bottom deviation value Y(m+1) to be decreased, for a greater amount as the peak 12A" and the bottom 12B" are located in farther positions apart from the reference position Ps toward the upstream side with regard to the forward orientation FWD; and affects the peak deviation value Y(m) and the bottom deviation value Y(m+1) to be increased, for a greater amount as the peak 12A" and the bottom 12B" are located in farther positions apart from the reference position Ps toward the downstream side with regard to the forward orientation FWD. In particular, with regard to the adjusting values $\beta(1)$ through $\beta(8)$, which are values to be applied to the peaks 12A" and the bottoms 12B" formed on the upstream side of the reference position Ps with regard to the forward orientation FWD, the farther the peaks 12A" and bottoms 12B" are apart from the reference position Ps, the smaller adjusting values $\beta(1)$ through $\beta(8)$ are applied to the peak adjusting values Y(m) and the bottom adjusting values Y(m+1). In this regard, the adjusting values $\beta(1)$ through $\beta(8)$ are smaller than or equal to zero (0). Meanwhile, with regard to the adjusting values $\beta(10)$ through $\beta(17)$, which are values to be applied to the peaks 12A" and the bottoms 12B" formed on the downstream side of the reference position Ps with regard to the forward orientation FWD, the farther the peaks 12A" and bottoms 12B" are apart from the reference position Ps, the greater adjusting values β(10) through β(17) are applied to the peak adjusting values Y(m) and the bottom adjusting values Y(m+1). In this regard, the adjusting values β(10)-through β(17) are greater than or equal to zero (0). Meanwhile, the adjusting value β(9) corresponding to the reference position Ps is zero (0). Largeness or smallness of the adjusting values β(1) through β(17) can be expressed in an inequality: β(1)≤β(2)≤β(3)≤β(4)≤β(5)≤β(6)≤β(7)≤β(8)≤β(9)≤β(10)≤β(11)≤β(12)≤β(13)≤β(14)≤β(15)≤β(16)≤β(17). In the present embodiment, the adjusting values β, which are used to adjust the peak deviation values (Y) and the bottom deviation values Y(m+1) for the peaks 12A" and the bottoms 12B" formed on the upstream side of the reference position Ps with regard to the forward orientation FWD may be represented by β(m); and the adjusting values β, which are used to adjust the peak deviation values (Y) and the bottom deviation values Y(n+1) for the peaks 12A" and the bottoms 12B" formed on the downstream side of the reference position Ps with regard to the forward orientation FWD may be represented by β(n).

The discharging timings for the recording head 39 to discharge the ink in the recording step C in S16 are obtained by adjusting the peak deviation values Y(m) and the bottom deviation values Y(m+1), which are adjusted by applying the adjusting value β and deviating the adjusted peak deviation values Y(m) and the bottom deviation values Y(m+1) from the reference value D0 respectively. In particular, the peak deviation values Y(m) and the bottom deviation values Y(m+1) are adjusted by adding the adjusting values β. Therefore, in the recording step C in S16, the discharging timings are obtained by dividing the adjusted peak deviation values Y(m) and the adjusted bottom deviation values Y(m+1) by the moving velocity V of the carriage 39, multiplying the divided quotient by ½, and adding the multiplied value to the reference value D0.

Thus, in the recording step C in S16, the discharging timings to discharge the ink toward the peaks 12A" formed on the upstream side of the reference position Ps with regard to the forward orientation FWD, i.e., the corrected peak-targeted discharging positions Ea", are expressed as D0+(Y(m)+β(m))/2V; and the discharging timings to discharge the ink toward the bottoms 12B" formed on the upstream side of the reference position Ps with regard to the forward orientation FWD, i.e., the corrected bottom-targeted discharging positions Eb", are expressed as D0+(Y(m+1)+β(m+1))/2V. Meanwhile, the discharging timings to discharge the ink toward the peaks 12A" formed on the downstream side of the reference position Ps with regard to the forward orientation FWD, i.e., the corrected peak-targeted discharging positions Ea", are expressed as D0+(Y(n)+β(n))/2V; and the discharging timings to discharge the ink toward the bottoms 12B" formed on the downstream side of the reference position Ps with regard to the forward orientation FWD, i.e., the corrected bottom-targeted discharging positions Eb", are expressed as D0+(Y(n+1)+β(n+1))/2V.

Therefore, the controller 130 manipulates the recording head 39 to discharge the ink toward the peaks 12A" formed on the upstream side of the reference position Ps with regard to the forward orientation FWD at the discharging timings D0+(Y(m)+β(m))/2V, and toward the bottoms 12B" formed on the upstream side of the reference position Ps with regard to the forward orientation FWD at the discharging timings D0+(Y(m+1)+β(m+1))/2V. Meanwhile, the controller 130 manipulates the recording head 39 to discharge the ink toward the peaks 12A" formed on the downstream side of the reference position Ps with regard to the forward orientation FWD at the discharging timings D0+(Y(n)+β(n))/2V, and toward the bottoms 12B" formed on the downstream side of the reference position Ps with regard to the forward orientation FWD at the discharging timings D0+(Y(n+1)+β(n+1))/2V. Thus, in the recording step C in S16, as shown in FIG. 11, the inks targeted at the positions on the upstream side of the reference position Ps with regard to the forward orientation FWD are discharged in advanced discharging timings compared to the discharging timings in the recording step A in S14, and the inks targeted at the positions on the downstream side of the reference position Ps with regard to the forward orientation FWD are discharged in delayed discharging timings compared to the discharging timings in the recording step A in S14.

Thus, the expressions D0+(Y(m)+β(m))/2V, D0+(Y(m+1)+β(m+1))/2V, D0+(Y(n)+β(n))/2V, and D0+(Y(n+1)+β(n+1))/2V represent the discharging timings in the recording step C in S16. The reference value D0; the peak deviation values Y(m), Y(n); the adjusting values β(m); and the moving velocity V of the carriage 39 are used to obtain the discharging timings (i.e., the corrected peak-targeted discharging positions Ea") to discharge the ink so that the ink should land on the peaks 12A". The reference value D0; the peak deviation values Y(m+1), Y(n+1); the adjusting values β(m+1); and the moving velocity V of the carriage 39 are used to obtain the discharging timings (i.e., the corrected bottom-targeted discharging positions Eb") to discharge the ink so that the ink should land on the bottoms 12B".

In the following description, the discharging timings to discharge the ink toward the sheet 12 in the recording step A (S14) may be referred to as first discharging timings. The discharging timings to discharge the ink toward the sheet 12 in the recording step C (S16) may be referred to as second discharging timings, while the discharging timings to discharge the ink toward the sheet 12 in the recording step B (S15) may be referred to as third discharging timings.

[Discharging Timings for Transitional Positions]

In the recording step A in S14, meanwhile, the controller 130 calculates the first discharging timings to discharge the ink at transitional positions between each peak 12A and bottom 12B and manipulates the recording head 39 to discharge the ink toward the transitional positions at the calculated first discharging timings. The first discharging timings for the transitional positions are obtained based on the peak deviation value Y(m), which is a peak deviation value Y(m) for one of the peaks 12A closest to the transitional position along the widthwise direction 9, and the bottom deviation value Y(m+1), which is a bottom deviation value Y(m+1) for one of the bottoms 12B closest to the transitional position along the widthwise direction 9. Further, an interpolating expression 1 described below and the reference value D0 are used for the calculation.

More specifically, the controller 130 fills the interpolating expression 1 with values (x, c) which identify the transitional position, the peak deviation value Y(m) of the peak 12A closest to the transitional position, and the bottom deviation value Y(m+1) of the bottom 12B closest to the transitional position. Thereby, a deviation value y', which indicates a deviated amount between the targeted transitional position and a landing position for the ink discharged D0 second(s) before the carriage 23 reaches a position straight above the targeted transitional position along the widthwise direction 9, is calculated. Thereafter, the controller 130 fills expression 2 described below with the deviation value y' and the reference value D0. Thus, the discharging timing to discharge the ink toward the targeted transitional position is obtained. The controller 130 repeats the calculations for all the transitional positions in between each peak 12A and bottom 12B.

$$y' = -\frac{1}{L^3}(Y_{(m+1)} - Y_{(m)})(x + c - X_{(m)})^2\{2(x + c - X_{(m)}) - 3L\} + Y_{(m)} \quad \text{[Expression 1]}$$

$$D_{(x)} = \frac{y'}{2V} + D_0 \quad \text{[Expression 2]}$$

The value x in the expression 1 identifies a position of the carriage 23 and is determined based on the pulse signals from the linear encoder 180. The value c in the expression 1 indicates a distance between the nozzle 40, of which discharging timing is being calculated, and a widthwise center of the recording head 39. The value X(m) in the expression 1 indicates the positions of the peak 12A and the bottom 12B closest to the transitional position and is determined based on the pulse signals from the linear encoder 180. The value L in the expression 1 indicates a distance between the peak 12A and the bottom 12B closest to the transitional position and is expressed as L=X(m+1)−X(m). The value V in the expression 2 indicates the moving velocity of the carriage 23.

In the recording step B in S15, meanwhile, the controller 130 fills the interpolating expression with the adjusted peak deviation values (Y(m)+α(m)) instead of the peak deviation values Y(m) and the adjusted bottom deviation values (Y(m+1)+α(m+1)) instead of the bottom deviation values Y(m+1) respectively to obtain the third discharging timings for the transitional positions. Thus, the controller 130 manipulates the recording head 39 to discharge the ink toward transitional positions in the sheet P at the calculated third discharging timings. In the recording step C in S16, on the other hand, the controller 130 fills the interpolating expression with the adjusted peak deviation values (Y(m)+β(m)) instead of the peak deviation values Y(m) and the adjusted bottom deviation values (Y(m+1)+β(m+1)) instead of the bottom deviation values Y(m+1) respectively to obtain the second discharging timings for the transitional positions. Thus, the controller 130 manipulates the recording head 39 to discharge the ink toward transitional positions in the sheet P at the calculated second discharging timings.

Next, in the image recording operation, in S17 (see FIG. 8), if an entire image for the image recording instruction is not completely recorded on the sheet (S17: NO) 12, in S18, the controller 130 transitively conveys the sheet 12 along the conveyance flow 16 for a predetermined linefeed amount. In particular, the controller 130 manipulates the conveyer motor 102 to rotate for a predetermined amount so that at least one of the conveyer roller unit 54 and the ejection roller unit 55 is driven to convey the sheet 12 for the predetermined linefeed amount. Accordingly, a next recordable range in the sheet 12 is placed to face the recording head 39.

Following S17, the controller 130 repeats S12-S18 until the entire image is completely recorded on the sheet 12. When the entire image is completely recorded on the sheet 12 (S17: YES), in S19, the controller 130 controls the rotation of the rollers so that sheet 12 is ejected in the dejection tray 21. In particular, the controller 130 manipulates the conveyer motor 102 to rotate for a predetermined amount. Thus, the sheet 12 is conveyed to the ejection tray 21 by the ejection roller unit 55 and ejected from the MFD 10.

[Usability of the Embodiment]

According to the embodiment described above, one of the recording steps A, B, C, in which the discharging timings are different from one another depending on the position of the sheet 12 in the conveyance flow 16 (i.e., the shape of the sheet 12 in the widthwise direction 9), is conducted. Therefore, while the sheet 12 is in a contracted condition in the widthwise direction 9, i.e., in the shape shown in the lower row in FIG. 10, the discharging timings to discharge the ink toward the upstream side of the reference position Ps on the sheet 12 with regard to the forward orientation FWD are delayed, and the discharging timings to discharge the ink toward the downstream side of the reference position Ps on the sheet 12 with regard to the forward orientation FWD are advanced. On the other hand, while the sheet 12 is in a stretched condition in the widthwise direction 9, i.e., in the shape shown in the lower row in FIG. 11, the discharging timings to discharge the ink toward the upstream side of the reference position Ps on the sheet 12 with regard to the forward orientation FWD are advanced, and the discharging timings to discharge the ink toward the downstream side of the reference position Ps on the sheet 12 with regard to the forward orientation FWD are delayed. Thus, the deviation of the ink on the sheet 12 from the targeted positions can be restrained throughout the width of the sheet 12.

According to the embodiment described above, the discharging timings are modified after the tail end of the sheet 12 passes through the position A and further modified after the tail end of the sheet 12 passes through the position B. However, it is noted that the tail end of the sheet 12 may not necessarily stop at the position between the position A and the position B; therefore, for example, the recording step B may be omitted. In other words, the controller 130 may conduct the recording step A until the tail end of the sheet 12 passes through the position B and conducts the recording step C after the tail end of the sheet 12 passes through the position B.

Further, the discharging timings may be modified after a leading end of the sheet 12 passes through the corrugating spurs 68. The leading end of the sheet 12 refers to a downstream end of the sheet 12 being conveyed with regard to the direction of the conveying flow 16. For example, the controller 130 may conduct the recording step C until the leading end of the sheet 12 passes through the corrugating spurs 68 and conducts the recording step A after the leading end of the sheet 12 passes through the corrugating spurs 68. The control in this example may be performed in addition to or independently from the image recording operation shown in FIG. 8. In other words, this exemplary control may be performed in an MFD 10, which is not equipped with the contact pieces 80.

According to the embodiment described above, the discharging timings for other targeted positions which is, for example, the targeted positions for the transient positions between the peaks 12A and the bottoms 12B, are calculated by filling the interpolating expression with the peak deviation values Y(m) and the bottom deviation values Y(m+1); therefore, it is not necessary to store peak and bottom deviation values for each one of innumerably existing transitional positions in the EEPROM 134. Thus, a memory size for the EEPROM 134 may be maintained smaller. Further, while the discharging timings for the transitional positions are calculated based on the adjusted peak deviation values adjusted by the adjusting values α and β, the ink can be discharged in the adjusted preferable discharge timings.

In the embodiment described above, it has been described that the reference value D0 is a parameter representing the reference timing, and the peak deviation value Y(m) and the bottom deviation value Y(m+1) are parameters representing the deviated distances. However, the parameters for the adjustment may not necessarily be limited to those, but other parameters which can specify the discharging timings may arbitrarily be used. For example, the reference value D0, the peak deviation value Y(m), and the bottom deviation value Y(m+1) may be expressed by timings or in distances uniformly.

According to the embodiment described above, the position of the bottom 12B at the widthwise center along the widthwise direction 9 is defined as the reference position Ps; however, the reference position Ps may not necessarily be coincident with the position of the bottom 12B at the widthwise center. For example, a position of a widthwise center of the sheet 12 in the widthwise direction 9 may be defined as the reference position Ps. For another example, a position of one of widthwise ends of the platen 42 in the widthwise direction 9 may be defined as the reference position Ps. Further, the sheet 12 may not necessarily be center-aligned at the widthwise center of the bottom panel 91 in the feeder tray 20 but may be placed to align with a widthwise end in the feeder tray 20.

Although an example of carrying out the invention has been described, those skilled in the art will appreciate that there are numerous variations and permutations of the inkjet printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

More Examples

With reference to FIGS. 13A-13D, processes, in which the third and second discharging timings to be used in the recording steps B, C are further modified, will be described. The flows shown in FIGS. 13A-13D may be used, when specific conditions are met, to modify the second and third discharging timings from the first discharging timings for larger extent than the extent to adjust the first discharging timings when the specific conditions are not met. In this regard, a method to modify the second and third discharging timings for the larger extent may not necessarily be limited. For example, the second and third discharging timings may be adjusted for the larger extent by increasing absolute values in the adjusting values α, β.

With reference to FIG. 13A, a flow to modify the second and third discharging timings depending on a type of the sheet 12 will be described. The flow shown in FIG. 13A is based on an assumption that a dimension of a less rigid sheet 12 in the widthwise direction 9 tends to change for a larger amount along the widthwise direction 9 as the tail end of the sheet 12 passes through the position A and the position B compared to a rigid sheet 12.

As the flow starts, in S31, the controller 130 judges a type of the sheet 12. If the sheet 12 is a regular sheet of paper (S31: YES), in S32, the controller 130 increases the absolute values in the adjusting values α, β. On the other hand, if the sheet 12 is a glossy sheet (S31: NO), the controller 130 does not change the absolute values in the adjusting values α, β. The judgment in S31 may be made, for example, based on information indicating the type of the sheet 12, which may be included in the image recording instruction. In the flow shown in FIG. 13A, the discharging timings are modified depending on the type of the sheet 12. However, the type of the sheet 12 may not necessarily be limited to the regular sheet and the glossy sheet. In other words, in S32, the absolute values in the adjusting values α, β may be increased when rigidity of the sheet 12 is lower than a predetermined threshold.

Next, with reference to FIG. 13B, a flow to modify the second and third discharging timings depending on an aligning direction of fiber in the sheet 12 will be described. When the sheet 12 is conveyed in a parallel state that the fiber alignment thereof is parallel to the conveyance flow 16, the sheet 12 tends to change for a larger amount along the widthwise direction 9 as the tail end of the sheet 12 passes through the position A and the position B compared to when the sheet 12 is conveyed in a no-parallel state that the fiber alignment thereof is cross to the conveyance flow 16 (in other words, the fiber alignment thereof is parallel to the widthwise direction 8).

Therefore, as the flow starts, in S41, the controller 130 judges alignment of the fiber in the sheet 12. If the sheet 12 is in the parallel state (S41: YES), in S42, the controller 130 increases the absolute values in the adjusting values α, β. On the other hand, if the sheet 12 is in the non-parallel state (S41: NO), the controller 130 does not change the absolute values in the adjusting values α, β. The judgment in S41 may be made, for example, based on information indicating the fiber alignment in the sheet 12 (i.e., information concerning a size and/or arrangement of the sheet 12), which may be included in the image recording instruction.

Next, with reference to FIG. 13C, a flow to modify the second and third discharging timings depending on ambient temperature around the MFD 10 will be described. The flow shown in FIG. 13C is based on an assumption that the dimension of the sheet 12 in the widthwise direction 9 tends to change for a larger amount along the widthwise direction 9 when the ambient temperature is higher compared to the amount of the widthwise dimension to change in lower ambient temperature as the tail end of the sheet 12 passes through the position A and the position B.

Therefore, as the flow starts, in S51, the controller 130 judges the ambient temperature. If the ambient temperature is higher than a predetermined threshold (S51: YES), in S52, the controller 130 increases the absolute values in the adjusting values α, β. On the other hand, if the ambient temperature is lower than or equal to the predetermined threshold (S51: NO), the controller 130 does not change the absolute values in the adjusting values α, β. The MFD 10 in this example is equipped with a temperature sensor (not shown), which measures the temperature of the ambient air and notifies the controller 130 of the measured result. The judgment in S51 may be made, therefore, based on comparison of the measured temperature of the ambient air with the predetermined threshold. A location of the temperature sensor is not necessarily limited.

Next, with reference to FIG. 13D, a flow to modify the second and third discharging timings depending on ambient humidity around the MFD 10 will be described. The flow shown in FIG. 13D is based on an assumption that the dimension of the sheet 12 in the widthwise direction 9 tends to change for a larger amount along the widthwise direction 9 when the ambient humidity is higher compared to the amount of the widthwise dimension to change in lower ambient humidity as the tail end of the sheet 12 passes through the position A and the position B.

Therefore, as the flow starts, in S61, the controller 130 judges the ambient humidity. If the ambient humidity is higher than a predetermined degree of humidity (S61: YES), in S62, the controller 130 increases the absolute values in the adjusting values α, β. On the other hand, if the ambient humidity is lower or equal to the predetermined degree of humidity (S61: NO), the controller 130 does not change the absolute values in the adjusting values α, β. The MFD 10 in this example is equipped with a humidity sensor (not shown), which measures the humidity of the ambient air and notifies the controller 130 of the measured result. The judgment in S61 may be made, therefore, based on comparison of the measured humidity of the ambient air with the predetermined threshold. A location of the humidity sensor is not necessarily limited.

Each of the modifying flows shown in FIGS. 13A-13D may be performed alone or in combination with one another in between, for example, S12 and S13 (see FIG. 8). With the modifying flows, the ink may be discharged at the sheet 12 in even more preferable discharging timings according to the condition of the sheet 12.

In the present embodiment, the adjusting values $\alpha(1)$ through $\alpha(17)$ and $\beta(1)$ through $\beta(17)$ are stored in the EEPROM 134; however, the adjusting values $\alpha(1)$ through $\alpha(17)$ or $\beta(1)$ through $\beta(17)$ may not necessarily be stored in the EEPROM 134. For example, the controller 130 may be equipped with a calculating means to calculate a linear equation $Y'=Y+(X(m)-X(c))C$. The calculating means may be, for example, achieved by the controller 130 executing a software program or by a hardware circuits cooperating with the software program. In other words, the controller 130 may adjust the values Y, i.e., Y(m) and Y(m+1), by the above-mentioned linear equation expressed by Y'.

It is noted that the value Y mentioned above represents the deviation values including the peak deviation values Y(m) and the bottom deviation values Y(m+1). The values X(m) represent values, which identify the positions of the peaks 12A and the bottoms 12B and are determined based on the pulse signals from the linear encoder 180. The value X(c) represents a position of the bottom 12B, which is at the widthwise center on the widthwise direction 9, among the plurality of bottoms 12B. In other words, the value X(c) represents a position of the supporting rib 52, which is at the widthwise center on the widthwise direction 9, among the plurality of supporting ribs 52. These values X(m) and X(c) may be stored in the ROM 131 or in the EEPROM 134. The value C represents an inclination of the linear equation represented by Y'. The inclination C may vary in each MFD 10 and is stored in the EEPROM 134.

For example, in order to adjust the peak deviation value Y(2), the controller 130 obtains the peak deviation value Y(2) and the inclination C from the EEPROM 134 and the value X(2) and X(c) from the ROM 131 or the EEPROM 134. The controller 130 fills the linear equation with the obtained Y(2), C, X(2), and X(c) to calculate Y'(2). In this regard, if, for example, the recording head 39 on the carriage 23 moving in the forward orientation FWD discharges the ink at the position X(2), i.e., a position above the peak 12A(2), the discharged ink lands on a downstream position with respect to the peak 12A(2) with regard to the forward orientation FWD. Therefore, it is necessary that the controller 130 calculates the value Y'(2) so that the ink should be discharged from the recording head 39 on the carriage 23 moving in the forward orientation FWD in an upstream position with respect to the position X(2) for a predetermined distance. Thus, when the recording head 39 discharges the ink at the discharging timing indicated by Y'(2), the discharged ink lands on the peak 12A (2). The controller 130 may obtain the value Y' for each point before the carriage 23 starts moving in the forward orientation FWD.

For another example, the value C representing the inclination of the linear equation may include two or more different values C1, C2, etc. For example, inclination C1 may be used when the tail end of the sheet 12 is on a downstream side of the position A and on an upstream side of the position B with regard to the conveyance direction 16 (S13: A<tail end≤B in the flow shown in FIG. 8). In other words, when the tail end of the sheet 12 is in a position between the position A and the position B, the controller 130 may read the value C1 from the EEPROM 134 and adjust Y. In the meantime, inclination C2 may be used when the tail end of the sheet 12 is on a downstream side of the position B with regard to the conveyance flow 16 (S13: B<tail end in the flow shown in FIG. 8). In other words, when the tail end of the sheet 12 is on the downstream side of the position B, the controller 130 may read the value C2 and adjust Y. In this regard, C1 is smaller than C2 (C1<C2), and, according to the embodiment described above, C1 is a negative constant and C2 is appositive constant.

What is claimed is:

1. An inkjet printer comprising:

a conveyer configured to convey a sheet along a conveyance direction;

a recording head configured to discharge ink toward the sheet being conveyed by the conveyer;

a carriage mounting the recording head thereon and being configured to move along a scanning direction;

a corrugation mechanism configured to shape into a corrugated shape, in which an amount of a gap between the recording head and the sheet is increased and decreased alternately along the scanning direction, at a corrugating position; and a controller configured to execute an operation comprising:

a conveying step, in which the sheet is conveyed by the conveyer; and a recording step, in which the carriage is moved in the scanning direction and the recording head is manipulated to discharge the ink toward the sheet, wherein the recording step comprises:

a first discharging step, in which, after the conveying step and on condition that the sheet is present at the corrugating position, the recording head is manipulated to discharge the ink toward a targeted position on the sheet along the scanning direction at a first discharging timing; and a second discharging step, in which, after the conveying step and on condition that the sheet is absent at the corrugating position, the recording head is manipulated to discharge the ink toward the targeted position on the sheet along the scanning direction at a second discharging timing which is deviated from the first discharging timing, the farther the targeted position being separated from a reference position on the sheet along the scanning direction, the more largely the second discharging timing being deviated from the first discharging timing.

2. The inkjet printer according to claim 1, wherein, in the second discharging step, the ink targeted at the targeted position on an upstream side of the reference position in a moving orientation of the carriage is discharged at the second discharging timing, which is advanced to be earlier than the first discharging timing; and wherein, in the second discharging step, the ink targeted the targeted position on a downstream side of the reference position in the moving orientation is discharged at the second discharging timing, which is delayed to be later than the first discharging timing.

3. The inkjet printer according to claim 2, wherein the conveyer comprises:

a conveyer roller unit, the conveyer roller unit being disposed on an upstream side of the carriage in the conveyance direction and being configured to nip the sheet and convey the sheet along the conveyance direction; and wherein the corrugating position is between the conveyer roller unit and the recording head;

wherein the operation to be executed by the controller further comprise a detecting step, in which a position of a tail end of the sheet is detected;

wherein, in the recording step, while the position of the tail end of the sheet detected indicates that the tail end has not passed through the conveyer roller unit, the controller executes the first discharging step; and wherein, in the recording step, while the position of the tail end of the sheet detected indicates that the tail end has passed through the corrugating position, the controller executes the second discharging step.

4. The inkjet printer according to claim 3, wherein the recording step further comprises a third discharging step executed after the conveying step and on condition that the position of the tail of the sheet detected indicates that the tail end has passed through the conveyer roller unit but has not passed through the corrugating position, and in the third discharging step, the recording head is manipulated to discharge the ink toward the targeted position on the sheet along the scanning direction at a second discharging timing which is deviated from the first discharging timing, wherein, in the third discharging step, the ink targeted at the targeted position on the upstream side of the reference position in the moving orientation is discharged at a third discharging timing, which is delayed to be later than the first discharging timing;

wherein, in the third discharging step, the ink targeted at the targeted position on the downstream side of the reference position in the moving orientation is discharged at the third discharging timing, which is advanced to be earlier than the first discharging timing.

5. The inkjet printer according to claim 4, wherein the corrugation mechanism is configured to shape the sheet into the corrugated shape having a plurality of protrusive points, at which tendency of the amount of the gap between the recording head and the sheet turns from decreasing to increasing, and a plurality of recessed points, at which tendency of the amount of the gap turns from increasing to decreasing, the protrusive points and the recessed points being formed alternately along the scanning direction:

wherein the target position toward which the ink is discharged includes a plurality of targeted positions on the protrusive points and the recessed points;

wherein, in the second discharging step and in the third discharging step, the recording head is manipulated to discharged the ink toward the targeted positions on the protrusive and the recessed points at a second discharging timing and third discharged timing which are deviated from the first discharging timing, the farther targeted positions being separated from the reference position on the sheet along the scanning direction, the more largely both the second discharging timing and third discharging timing being deviated from the first discharging timing.

6. The inkjet printer according to claim 5, further comprising:

a memory device configured to store:

a reference value indicating a reference discharging timing;

a plurality of protrusion deviation values used to delay the first discharging timing for the protrusive points from the reference discharging timing;

a plurality of recess deviation values used to advance the first discharging timing for the recessed points from the reference discharging timing; and a plurality of first adjusting values and a plurality of second adjusting values used to adjust the protrusion deviation values and the recess deviation values;

wherein the farther targeted positions on the protrusive points and the recessed points are separated from the reference position toward the upstream side in the moving orientation of carriage, the more largely the first adjusting values decrease the protrusion deviation values and the recess deviation values; and the farther the targeted positions on the protrusive points and the recessed points are separated from the reference position toward the downstream side in the moving orientation of carriage, the more largely the first adjusting values increase the protrusion deviation values and the recess deviation values;

wherein the farther targeted positions on the protrusive points and the recessed points are separated from the reference position toward the upstream side of the reference position in the moving orientation of the carriage, the more largely the second adjusting values increase the protrusion deviation values and the recess deviation values; and the farther the targeted positions on the protrusive points and the recessed points are separated from the reference position toward the downstream side of the reference position in the moving orientation of the carriage, the more largely the second adjusting values decrease the protrusion deviation values and the recess deviation values;

wherein, in the first discharging step, the controller manipulates the recording head to discharge the ink toward the targeted positions on the protrusive points and the recessed points at the first discharging timings, which are deviated from the reference value for lengths corresponding to the protrusion deviation values and the recess deviation values;

wherein, in the second discharging step, the controller manipulates the recording head to discharge the ink toward the targeted positions on the protrusive points and the recessed points at the second discharging timings, which are deviated from the reference value for lengths corresponding to the protrusion deviation values adjusted by the first adjusting values and the recess deviation values adjusted by the first adjusting values; and wherein, in the third discharging step, the controller manipulates the recording head to discharge the ink toward the targeted positions on the protrusive points and the recessed points at the third discharging timings, which are deviated from the reference value for lengths corresponding to the protrusion deviation values adjusted by the second adjusting values and the recess deviation values adjusted by the second adjusting values.

7. The inkjet printer according to claim 6, wherein, the farther the targeted positions on the protrusive points and the recessed points on the upstream side of the reference position in the moving orientation are separated from the reference position, the smaller first adjusting values being smaller than or equal to 0 are applied to the protrusion deviation values and the recess deviation values;

wherein, the farther the targeted positions on the protrusive points and the recessed points on the downstream side of the reference position in the moving orientation are separated from the reference position, the greater first adjusting values being greater than or equal to 0 are applied to the protrusion deviation values and the recess deviation values;

wherein, the farther the targeted positions on the protrusive points and the recessed points on the upstream side of the reference position in the moving orientation are separated from the reference position, the greater second adjusting values being greater than or equal to 0 are applied to the protrusion deviation values and the recess deviation values;

wherein, the farther the targeted positions on the protrusive points and the recessed points on the downstream side of the reference position in the moving orientation are separated from the reference position, the smaller second adjusting values being smaller than or equal to 0 are applied to the protrusion deviation values and the recess deviation values;

wherein, in the second discharging step, the protrusion deviation values and the recess deviation values are adjusted by adding the first adjusting values; and wherein, in the third discharging step, the protrusion deviation values and the recess deviation values are adjusted by adding the second adjusting values.

8. The inkjet printer according to claim 7, wherein, in the first discharging step, the controller manipulates the recording head to discharge the ink toward the targeted position in a transitional position between adjoining protrusive point and recessed point at the first discharging timing, which is deviated from the reference value for a length corresponding to a deviation value, the deviation value being obtained by filling a predetermined interpolating function with the protrusion deviation value and the recess deviation value for the adjoining protrusive point and recessed point; and wherein, in the second discharging step, the controller manipulates the recording head to discharge the ink toward the targeted position in the transitional position at the second discharging timing, which is deviated from the reference value for a length corresponding to a first adjusted deviation value, the first adjusted deviation value being obtained by filling the predetermined interpolating function with the protrusion deviation value and the recess deviation value adjusted by the first adjusting values for the adjoining protrusive point and recessed point; and wherein, in the third discharging step, the controller manipulates the recording head to discharge the ink toward the targeted position in the transitional position at the third discharging timing, which is deviated from the reference value for a length corresponding to a second adjusted deviation value, the second adjusted deviation value being obtained by filling the predetermined interpolating function with the protrusion deviation value and the recess deviation value adjusted by the second adjusting values for the adjoining protrusive point and recessed point.

9. The inkjet printer according to claim 1, wherein the corrugation mechanism is configured to the sheet into the corrugated shape having a plurality of protrusive points, at which tendency of the amount of the gap between the recording head and the sheet turns from decreasing to increasing, and a plurality of recessed points, at which the tendency of the amount of the gap between the recording head and the sheet turns from increasing to decreasing, the protrusive points and the recessed points being formed alternately along the main scanning direction;

wherein the target position toward which the ink is discharged in the discharging step includes a plurality of targeted positions on the protrusive points and the recessed points.

10. The inkjet printer according to claim 9, further comprising:

a memory device configured to store:

a reference value indicating a reference discharging timing;

a plurality of protrusion deviation values used to delay the first discharging timing for the protrusive points from the reference discharging timing;

a plurality of recess deviation values used to advance the first discharging timing for the recessed points from the reference discharging timing; and a plurality of adjusting values used to adjust the protrusion deviation values and the recess deviation values;

wherein the farther the targeted positions on the protrusive points and the recessed points being separated from the reference position toward the upstream side of the reference position with regard to a moving orientation of the carriage, the more largely the protrusion deviation values and the recess deviation values being decreased; and the farther the targeted positions on the protrusive points and the recessed points being separated from the reference position toward the downstream side of the reference position with regard to the moving orientation of the carriage, the more largely the protrusion deviation values and the recess deviation values being increased;

wherein, in the first discharging step, the controller manipulates the recording head to discharge the ink toward the targeted positions on the protrusive points and the recessed points at the first discharging timings, which are deviated from the reference value for lengths corresponding to the protrusion deviation values and the recess deviation values; and wherein, in the second discharging step, the controller manipulates the recording head to discharge the ink toward the targeted positions on the protrusive points and the recessed points at the second discharging timings, which are deviated from the reference value for lengths corresponding to the protrusion deviation values adjusted by the adjusting values and the recess deviation values adjusted by the adjusting values.

11. The inkjet printer according to claim 10, wherein, the farther the targeted positions on the protrusive points and the recessed points on the upstream side of the reference position in the moving orientation are separated from the reference position, the smaller adjusting values being smaller than or equal to 0 are applied to the protrusion deviation values and the recess deviation values;

wherein, the farther the targeted positions on the protrusive points and the recessed points on the downstream side of the reference position in the moving orientation are separated from the reference position, the greater adjusting values being greater than or equal to 0 are applied to the protrusion deviation values and the recess deviation values;

wherein the protrusion deviation values and the recess deviation values are adjusted by adding the adjusting values.

12. The inkjet printer according to claim 11, wherein, in the first discharging step, the controller manipulates the recording head to discharge the ink toward the targeted position in a transitional position between adjoining protrusive point and recessed point at the first discharging timing, which is deviated from the reference value for a length corresponding to a deviation value, the deviation value being obtained by filling a predetermined interpolating function with the protrusion deviation value and the recess deviation value for the adjoining protrusive point and recessed point; and wherein, in the second corrected discharging step, the controller manipulates the recording head to discharge the ink toward the targeted position in the transitional position at the second discharging timing, which is deviated from the reference value for a length corresponding to an adjusted deviation value, the adjusted deviation value being obtained by filling the predetermined interpolating function with the protrusion deviation value and the recess deviation value adjusted by the adjusting values for the adjoining protrusive point and recessed point.

13. The inkjet printer according to claim 10, wherein the reference value indicates a length of time period, which is required for the ink discharged from the recording head to land on a center position among the protrusive points and the recessed points on the sheet;

wherein the protrusion deviation values indicate distances between a reference discharging position, at which the recording head should discharge the ink toward the center position, and protrusion-targeted discharging positions, at which the recording head should discharge the ink toward the protrusive points, along the scanning direction;

wherein the recess deviation values indicate distances between the reference discharging position and recess-targeted discharging positions, at which the recording head should discharge the ink toward the recess points, along the scanning direction;

wherein the adjusting values indicate distances which adjust the protrusion deviation values and the recess deviation values according to the shape of the sheet;

wherein the controller calculates the first discharging timing by dividing the protrusion deviation values and the recess deviation values by a moving velocity of the carriage and adding the quotients to the reference value; and wherein the controller calculates the second discharging timing by dividing the protrusion deviation values adjusted by the adjusting values and the recess deviation values adjusted by the adjusting values by the moving velocity of the carriage and adding the quotients to the reference value.

14. The inkjet printer according to claim 1, wherein the conveyer comprises:

an ejection roller unit, the ejection roller unit being disposed on a downstream side of the carriage in the conveyance direction and being configured to nip the sheet conveyed by the conveyer roller unit and convey the sheet along the conveyance direction, wherein the corrugating position, in which the corrugation mechanism shapes the sheet into the corrugated shape, is on a downstream side of the ejection roller unit in the conveyance direction;

wherein the steps to be executed by the controller further comprise a detecting step, in which a position of a leading end of the sheet is detected;

wherein, in the recording step, while the position of the leading end of the sheet detected in the detecting step indicates that the leading end has not passed through the corrugating position, the controller executes the second discharging step; and wherein, in the recording step, while the position of the leading end of the sheet detected in the detecting step indicates that the leading end has passed through the corrugating position, the controller executes the first discharging step.

15. The inkjet printer according to claim 1, wherein, in the second discharging step, the controller manipulates the recording head to discharge the ink toward the targeted position on the sheet of a first type, at the second discharging timing, which is deviated from the first discharging timing more largely than the second discharging timing to discharge the ink toward the sheet of a second type, the second type being a type of the sheet, of which rigidity is greater than the first type.

16. The inkjet printer according to claim 1, wherein, in the second discharging step, the controller manipulates the recording head to discharge the ink toward the targeted position on the sheet in a first-typed alignment, in which fiber contained in the sheet aligns along the conveyance direction, at the second discharging timing, which is deviated from the first discharging timing more largely than the second discharging timing to discharge the ink toward the sheet in a second-typed alignment, in which fiber contained in the sheet aligns to intersect with the conveyance direction.

17. The inkjet printer according to claim 1, further comprising:

a temperature sensor, wherein, in the second discharging step, the controller manipulates the recording head to discharge the ink toward the targeted position on the sheet, when temperature measured by the temperature sensor is higher than a predetermined threshold, at the second discharging timing, which is deviated from the first discharging timing more largely than the second discharging timing to discharge the ink toward the sheet when the temperature is lower than or equal to the threshold.

18. The inkjet printer according to claim 1, further comprising:

a humidity sensor, wherein, in the second discharging step, the controller manipulates the recording head to discharge the ink toward the targeted position on the sheet, when humidity measured by the humidity sensor is higher than a predetermined threshold, at the second discharging timing, which is deviated from the first discharging timing more largely than the second discharging timing to discharge the ink toward the sheet when the humidity is lower than or equal to the threshold.

19. The inkjet printer according to claim 1, further comprising a platen configured to support the sheet being conveyed by the conveyer;

wherein the corrugation mechanism comprises:

a plurality of contact pieces arranged on an upstream side of the recording head with regard to the conveyance direction in positions spaced apart from one another along the scanning direction, the plurality of contact pieces being arranged to be in contact with an upper surface of the sheet; and a plurality of ribs formed on the platen and arranged to contact a lower surface of the sheet at upper positions with respect to lower ends of the contact pieces, wherein the plurality of contact pieces and the plurality of ribs are arranged alternately along the main scanning direction.

20. The inkjet printer according to claim 1, wherein the controller repeats the conveying step and the recording step alternately.

21. A method to record an image on a sheet in an inkjet printer, comprising steps of:

conveying the sheet by a conveyer; and recording by moving a carriage in a scanning direction, and manipulating a recording head mounted on the carriage to discharge ink toward the sheet shaped into a corrugated shape along the scanning direction at a corrugating position, wherein the step of recording comprises:

a first discharging step, in which, after the conveying step and on condition that the sheet is present at the corrugating position, the recording head is manipulated to discharge the ink toward a targeted position on the sheet along the scanning direction at a first discharging timing; and a second discharging step, in which, after the conveying step and on condition that the sheet is absent at the corrugating position, the recording head is manipulated to discharge the ink toward the targeted position on the sheet along the scanning direction at a second discharging timing which is deviated from the first discharging timing, the farther the targeted position being separated from a reference position on the sheet along the scanning direction, the more largely the second discharging timing being deviated from the first discharging timing.

* * * * *